US009746814B2

(12) United States Patent
Furukawa

(10) Patent No.: US 9,746,814 B2
(45) Date of Patent: Aug. 29, 2017

(54) IMAGE FORMING APPARATUS

(71) Applicant: Brother Kogyo Kabushiki Kaisha, Nagoya-shi, Aichi-ken (JP)

(72) Inventor: Toshio Furukawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/368,881

(22) Filed: Dec. 5, 2016

(65) Prior Publication Data

US 2017/0082968 A1 Mar. 23, 2017

Related U.S. Application Data

(63) Continuation of application No. 14/926,127, filed on Oct. 29, 2015, now Pat. No. 9,529,316.

(30) Foreign Application Priority Data

Oct. 31, 2014 (JP) ..... 2014-222323
Sep. 18, 2015 (JP) ..... 2015-185379

(51) Int. Cl.
*G03G 15/00* (2006.01)
*G03G 15/16* (2006.01)
(Continued)

(52) U.S. Cl.
CPC ..... *G03G 15/80* (2013.01); *G03G 15/1675* (2013.01); *G03G 21/0011* (2013.01);
(Continued)

(58) Field of Classification Search
USPC ..... 399/72
See application file for complete search history.

(56) References Cited

U.S. PATENT DOCUMENTS 6,965,742 B2 * 11/2005 Miyamoto ..... G03G 15/1675 399/301
7,983,580 B2 * 7/2011 Kim ..... G03G 15/1605 399/45
(Continued)

FOREIGN PATENT DOCUMENTS

JP H11-194690 A 7/1999
JP 2002-258567 A 9/2002
(Continued)

*Primary Examiner* — Clayton E LaBalle
*Assistant Examiner* — Warren K Fenwick
(74) *Attorney, Agent, or Firm* — Banner & Witcoff, Ltd.

(57) ABSTRACT

An image forming apparatus includes a belt, a plurality of image forming devices including a photosensitive member, a developing device, a transfer device and a blade, and a control device configured to form a pattern image on a first photosensitive member, when an image to be printed on a sheet is not formed, by applying a developing voltage to a first developing device, an absolute value thereof is greater than that when an image to be printed on a sheet is formed, transfer the pattern image onto the belt and apply a transfer voltage or transfer current having the same polarity as that applied to a second transfer device when an image to be printed on a sheet is formed to the second transfer device when the pattern image to be conveyed by the belt passes the second transfer device.

20 Claims, 14 Drawing Sheets

(51) Int. Cl.
*G03G 21/00* (2006.01)
*G03G 21/18* (2006.01)

(52) U.S. Cl.
CPC ..... *G03G 21/1867* (2013.01); *G03G 21/0094* (2013.01); *G03G 2215/0132* (2013.01)

(56) References Cited

U.S. PATENT DOCUMENTS 8,244,164 B2 * 8/2012 Saito ..... G03G 15/0907 399/269
2003/0059231 A1 * 3/2003 Watanabe ..... G03G 21/0064 399/129
2005/0260006 A1 * 11/2005 Matsuda ..... G03G 15/0275 399/50
2007/0231009 A1 * 10/2007 Watahiki ..... G03G 15/5008 399/167
2008/0069614 A1 * 3/2008 Shintani ..... G03G 21/0035 399/346
2009/0067890 A1 * 3/2009 Maeyama ..... G03G 15/0815 399/273
2012/0141151 A1 6/2012 Yokoyama
2014/0017605 A1 * 1/2014 Shirayama ..... G03G 15/75 430/56
2014/0348555 A1 * 11/2014 Sato ..... G03G 15/0808 399/281
2016/0048091 A1 * 2/2016 Ishii ..... G03G 15/0266 399/50

FOREIGN PATENT DOCUMENTS

JP 2006-126603 A 5/2006
JP 2006-243657 A 9/2006
JP 2007-192987 A 8/2007
JP 2012-123357 A 6/2012
JP 2012-203255 A 10/2012

* cited by examiner

| | DEVELOPING ROLLER SPEED (mm/s) | PHOTOSENSITIVE MEMBER SPEED (mm/s) | PERIPHERAL SPEED RATIO | DEVELOPING VOLTAGE (V) | TRANSFER CURRENT (μA) | | | |
|---|---|---|---|---|---|---|---|---|
| | | | | | K | Y | M | C |
| SHEET IMAGE FORMATION | 200 | 120 | 1.67 | 300 | 10 | 10 | 11 | 12 |
| FIRST REVERSE TRANSFER | 200 | 120 | 1.67 | 500 | 20 | 20 | 22 | 24 |

| | DEVELOPING ROLLER SPEED (mm/s) | PHOTOSENSITIVE MEMBER SPEED (mm/s) | PERIPHERAL SPEED RATIO | DEVELOPING VOLTAGE (V) | TRANSFER CURRENT (μA) | | | |
|---|---|---|---|---|---|---|---|---|
| | | | | | K | Y | M | C |
| SHEET IMAGE FORMATION | 200 | 120 | 1.67 | 300 | 10 | 10 | 11 | 12 |
| SECOND REVERSE TRANSFER | 200 | 60 | 3.33 | 500 | 10 | 10 | 11 | 12 |

| | DEVELOPING ROLLER SPEED (mm/s) | PHOTOSENSITIVE MEMBER SPEED (mm/s) | PERIPHERAL SPEED RATIO | DEVELOPING VOLTAGE (V) | TRANSFER CURRENT (μA) | | | | CHARGING VOLTAGE (V) | | | |
|---|---|---|---|---|---|---|---|---|---|---|---|---|
| | | | | | K | Y | M | C | K | Y | M | C |
| SHEET IMAGE FORMATION | 200 | 120 | 1.67 | 300 | 10 | 10 | 11 | 12 | 700 | 700 | 700 | 700 |
| THIRD REVERSE TRANSFER | 200 | 60 | 3.33 | 500 | 10 | 0 | 0 | 0 | 700 | 0 | 0 | 0 |

FIG. 10

| | DEVELOPING ROLLER SPEED (mm/s) | PHOTO-SENSITIVE MEMBER SPEED (mm/s) | PERIPH-ERAL SPEED RATIO | DEVELOPING VOLTAGE (V) | TRANSFER VOLTAGE (V) | CHARGING VOLTAGE (V) | EXPOSURE | | | |
|---|---|---|---|---|---|---|---|---|---|---|
| | | | | | | | K | Y | M | C |
| SHEET IMAGE FORMATION | 200 | 120 | 1.67 | 300 | -1000 | 1200 | | | | |
| FOURTH REVERSE TRANSFER 1 | 200 | 60 | 3.33 | 500 | -1500 | 1200 | ON | OFF | OFF | OFF |
| FOURTH REVERSE TRANSFER 2 | 200 | 60 | 3.33 | 500 | -1500 | 1200 | ON | ON | OFF | OFF |
| FOURTH REVERSE TRANSFER 3 | 200 | 60 | 3.33 | 500 | -1500 | 1200 | ON | ON | ON | OFF |

FIG. 13

| | DEVELOPING ROLLER SPEED (mm/s) | PHOTO-SENSITIVE MEMBER SPEED (mm/s) | PERIPH-ERAL SPEED RATIO | DEVELOPING VOLTAGE (V) | TRANSFER CURRENT (μA) | | | |
|---|---|---|---|---|---|---|---|---|
| | | | | | K | Y | M | C |
| SHEET IMAGE FORMATION | 200 | 120 | 1.67 | 300 | 12 | 12 | 12 | 12 |
| FIFTH REVERSE TRANSFER 1 | 200 | 60 | 3.33 | 500 | 12 | 12 | 12 | 12 |
| FIFTH REVERSE TRANSFER 2 | 200 | 60 | 3.33 | 500 | 12 | 0 | 12 | 12 |
| FIFTH REVERSE TRANSFER 3 | 200 | 60 | 3.33 | 500 | 12 | 0 | 0 | 12 |

IMAGE FORMING APPARATUS

CROSS-REFERENCE TO RELATED APPLICATION

This application is a continuation of prior U.S. application Ser. No. 14/926,127, filed Oct. 29, 2015, which claims priority from Japanese Patent Application Nos. 2014-222323 filed on Oct. 31, 2014 and 2015-185379 filed on Sep. 18, 2015, the entire subject-matters of which are incorporated herein by reference.

TECHNICAL FIELD

The disclosure relates to an image forming apparatus configured to form an image by an electrophotographic method. More specifically, the disclosure relates to a technology of an image forming apparatus having a plurality of photosensitive members and capable of forming a color image.

BACKGROUND

In an image forming apparatus having a plurality of photosensitive members and capable of forming a color image, there has been known a technology of bringing a cleaning blade into contact with each photosensitive member and scraping toner remaining on a surface of each photosensitive member from the surface of each photosensitive member. There has also been known a technology of reducing friction, which is caused between the cleaning blade and the photosensitive member because the toner scraped from the surface of the photosensitive member by the cleaning blade stays at a contact part of the cleaning blade and the photosensitive member, and thus reducing a sound and a turn-up.

For example, there has been disclosed a configuration of the image forming apparatus having the cleaning blade contacted to each photosensitive member, in which a black image forming unit is configured to form a pattern image and to transfer the same to an intermediate transfer belt and image forming units corresponding to colors except for black are configured to reversely transfer toner of the pattern image from the intermediate transfer belt by a transfer bias having a reverse polarity to a printing process, at a timing except for the printing process.

SUMMARY

Illustrative aspects of the disclosure provide a technology capable of suppressing a sound and a turn-up, which are caused due to a cleaning blade, with a simple apparatus configuration in an image forming apparatus capable of forming a color image.

According to one illustrative aspect of the disclosure, there may be provided an image forming apparatus comprising: a belt; a plurality of image forming devices each comprising: a photosensitive member; a developing device configured to supply toner to the photosensitive member; a transfer device configured to transfer the toner supplied onto the photosensitive member to the belt; and a blade configured to contact a surface of the photosensitive member, wherein the plurality of image forming devices is arranged in a conveying direction of the toner on the belt; and a control device configured to: form a pattern image on a first photosensitive member, when an image to be printed on a sheet is not formed, by applying a developing voltage to a first developing device in which an absolute value of the developing voltage is greater than an absolute value of the developing voltage applied to the first developing device when an image to be printed on a sheet is formed, the first photosensitive member being the photosensitive member of a first image forming device of the plurality of image forming devices, the first developing device being the developing device of the first image forming device; transfer the pattern image formed on the first photosensitive member onto the belt by using a first transfer device, the first transfer device being the transfer device of the first image forming device; and apply a transfer voltage or transfer current, which has the same polarity as that applied to a second transfer device when an image to be printed on a sheet is formed, to the second transfer device when the pattern image to be conveyed by the belt passes the second transfer device, the second transfer device being the transfer device of a second image forming device of the plurality of image forming devices, the second image forming device being different from the first image forming device.

According to another illustrative aspect of the disclosure, there may be provided an image forming apparatus comprising: a belt; a plurality of image forming devices each comprising: a photosensitive member; a developing device configured to supply toner to the photosensitive member; a transfer device configured to transfer the toner supplied onto the photosensitive member to the belt; and a blade configured to contact a surface of the photosensitive member, wherein the plurality of image forming devices is arranged in a conveying direction of the toner on the belt; and a control device configured to: form a pattern image on a first photosensitive member, when an image to be printed on a sheet is not formed, by using a first developing device, the first photosensitive member being the photosensitive member of a first image forming device of the plurality of image forming devices, the first developing device being the developing device of the first image forming device; transfer the pattern image formed on the first photosensitive member onto the belt by applying a transfer voltage or transfer current to a first transfer device, wherein an absolute value of the transfer voltage or transfer current applied to the first transfer device in the transferring of the pattern image onto the belt is greater than an absolute value of the transfer voltage or transfer current applied to the first transfer device when an image to be printed on a sheet is formed, the first transfer device being the transfer device of the first image forming device; and apply a transfer voltage or transfer current, which has the same polarity as that applied to a second transfer device when an image to be printed on a sheet is formed, to the second transfer device when the pattern image to be conveyed by the belt passes the second transfer device, the second transfer device being the transfer device of a second image forming device of the plurality of image forming devices, the second image forming device being different from the first image forming device.

According to still another illustrative aspect of the disclosure, there may be provided an image forming apparatus comprising: a belt; a plurality of image forming devices each comprising: a photosensitive member; a developing device configured to supply toner to the photosensitive member; a transfer device configured to transfer the toner supplied onto the photosensitive member to the belt; and a blade configured to contact a surface of the photosensitive member, wherein the plurality of image forming devices is arranged in a conveying direction of the toner on the belt; and a control device configured to: form a pattern image on a first photosensitive member, when an image to be printed on a sheet is not formed, by using a first developing device, the first photosensitive member being the photosensitive member of a first image forming device of the plurality of image forming devices, the first developing device being the developing device of the first image forming device; adjust a ratio of a rotating speed of the first developing device to a toner conveying speed of the belt in the forming the pattern image onto the belt to be greater than a rotating speed ratio when an image to be printed on a sheet is formed; transfer the pattern image formed on the first photosensitive member onto the belt by using a first transfer device, the first transfer device being the transfer device of the first image forming device; and apply a transfer voltage or transfer current, which has the same polarity as that applied to a second transfer device when an image to be printed on a sheet is formed, to the second transfer device when the pattern image to be conveyed by the belt passes the second transfer device, the second transfer device being the transfer device of a second image forming device of the plurality of image forming devices, the second image forming device being different from the first image forming device.

A control method, a computer program and a non-transitory computer-readable storage medium having the computer program stored therein for implementing the functions of the image forming apparatus are also novel and useful.

BRIEF DESCRIPTION OF THE DRAWINGS

FIG. 10 depicts a list of controls of each device during a fourth reverse transfer operation;

FIG. 13 depicts a list of controls of each device during a fifth reverse transfer operation;

DETAILED DESCRIPTION

Hereinafter, an illustrative embodiment of the image forming apparatus of the disclosure will be described in detail with reference to the accompanying drawings. In the illustrative embodiment, the disclosure is applied to an electrophotographic printer capable of printing a color image.

Figure 1:
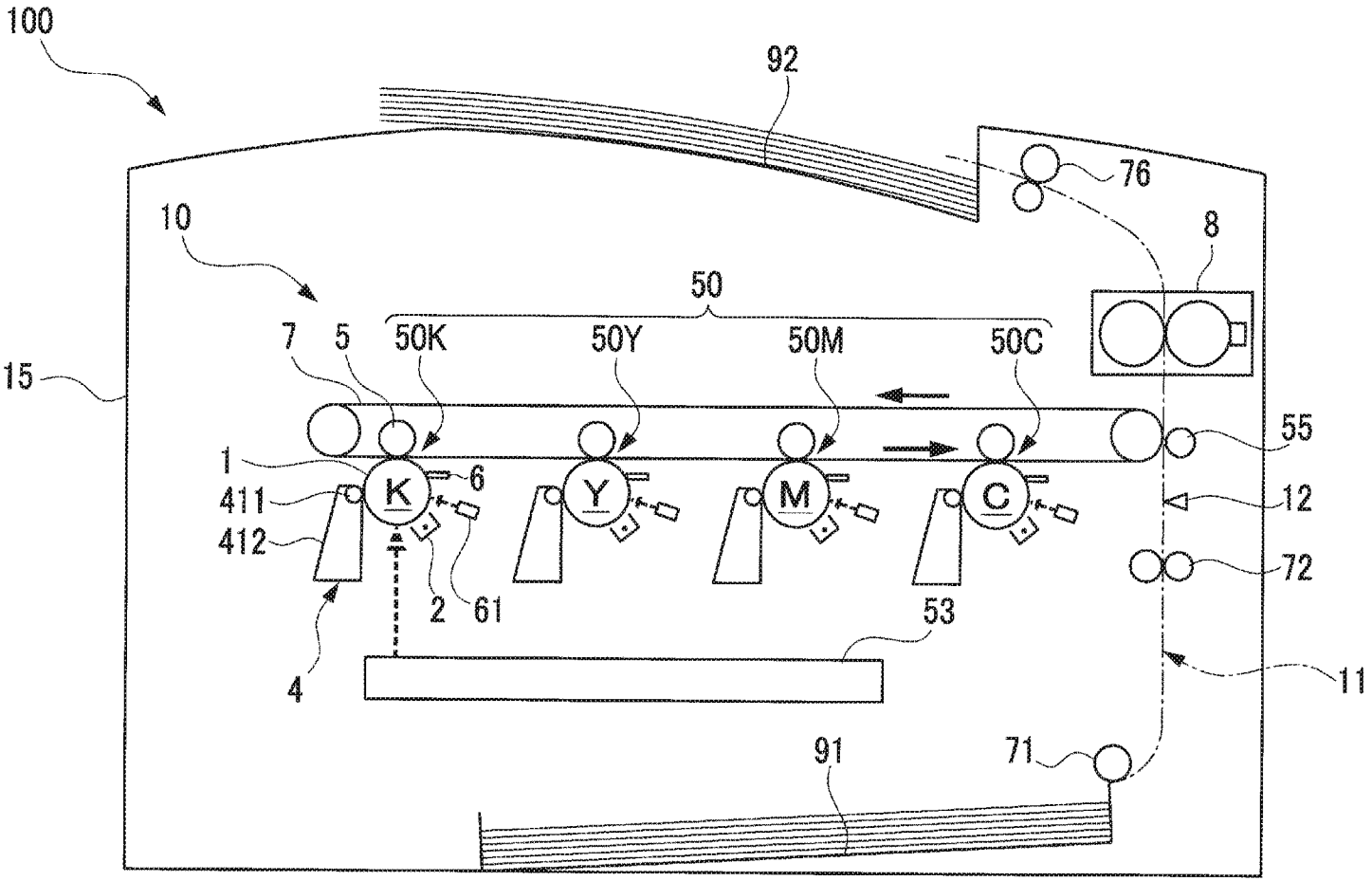
FIG. 1 depicts a schematic configuration of a printer according to an illustrative embodiment.

In the illustrative embodiment, as shown in FIG. 1, a printer 100 includes a printing unit 10 configured to form an image and to print the image on a sheet, a cover 15 configured to cover the printing unit 10, a sheet feeding tray 91 positioned at a bottom part and configured to accommodate therein a sheet before a printing, and a sheet discharge tray 92 positioned on an upper surface and configured to accommodate thereon the sheet after the printing. The printer 100 is an example of the image forming apparatus.

The printing unit 10 includes a process unit 50 configured to form a toner image by an electrophotographic method, an exposure device 53 configured to illuminate light to the process unit 50, a fixing device 8 configured to fix toner, which is not fixed yet, on a sheet, a conveyance belt 7 configured to convey the toner image formed by the process unit 50, a secondary transfer device 55 configured to transfer the toner image conveyed by the conveyance belt 7 to the sheet, and a sheet sensor 12 positioned at a more upstream side than the secondary transfer device 55 with respect to a sheet conveying direction and configured to output different signals depending on whether or not a sheet.

Also, in the printer 100, a conveyance path 11 (dashed-dotted line in FIG. 1) is provided so that the sheet accommodated in the sheet feeding tray 91 positioned at the bottom part passes a feeder roller 71, register rollers 72, the secondary transfer device 55, and the fixing device 8 and is guided to the upper sheet discharge tray 92 via sheet discharge rollers 76.

The process unit 50 can form a color image and has process units arranged in parallel and corresponding to respective colors of cyan (C), magenta (M), yellow (Y) and black (K). Specifically, the process unit 50 has a process unit 50C configured to form a cyan (C) image, a process unit 50M configured to form a magenta (M) image, a process unit 50Y configured to form a yellow (Y) image and a process unit 50K configured to form a black (K) image. The process units 50K, 50Y, 50M, 50C are arranged in corresponding order at an equal interval from an upstream side with respect to the conveying direction of the toner image, which is to be transferred to the sheet, on the conveyance belt 7. The process units 50K, 50Y, 50M, 50C are examples of the image forming unit, respectively.

The process unit 50K includes a drum-shaped photosensitive member 1, a charging device 2 configured to uniformly charge a surface of the photosensitive member 1, a developing device 4 configured to develop an electrostatic latent image on the photosensitive member 1 by toner, a transfer device 5 configured to transfer the toner image on the photosensitive member 1 to the conveyance belt 7, a cleaning blade 6 configured to contact the surface of the photosensitive member 1, and an LED eraser 61 configured to remove unnecessary charges on the photosensitive member 1. Also, the developing device 4 includes a toner tank 412 configured to accommodate therein toner, and a developing roller 411 configured to supply the toner in the toner tank 412 to the photosensitive member 1. In the toner tank 412 of the illustrative embodiment, the toner having a positive charging polarity is accommodated. The photosensitive member 1 and the transfer device 5 are arranged to contact the conveyance belt 7. The photosensitive member 1 is arranged to face the transfer device 5 with the conveyance belt 7 being interposed therebetween. The other process units 50C, 50M, 50Y also have the same configurations as the process unit 50K.

Also, each of the process units 50K, 50Y, 50M, 50C of the printer 100 has a mechanism capable of moving the developing roller 411 to at least two positions of an operating position at which the developing roller 411 is contacted to the photosensitive member 1 and a non-operating position at which the developing roller 411 is separated from the photosensitive member 1. At a state where the developing roller 411 is located at the operating position, each of the process units 50K, 50Y, 50M, 50C is applied with a driving force from a motor, which becomes a driving source as an image forming operation is performed, and the developing roller 411 is rotated by the driving force. Incidentally, at a state where the developing roller 411 is located at the non-operating position, the developing roller 411 is not rotated.

In each of the process units 50K, 50Y, 50M, 50C, the surface of the photosensitive member 1 is uniformly charged by the charging device 2. Thereafter, each of the process units 50K, 50Y, 50M, 50C is exposed by the light emitted from the exposure device 53, so that an electrostatic latent image is formed on the photosensitive member 1. Then, the toner in the toner tank 412 is supplied to the photosensitive member 1 via the developing roller 411 of the developing device 4. Thereby, the electrostatic latent image on the photosensitive member 1 becomes visible as a toner image. In each of the process units 50K, 50Y, 50M, 50C, the formed toner image is transferred to the surface of the conveyance belt 7 by the transfer device 5. At this time, in case of the color printing, the toner images are respectively formed by the process units 50K, 50Y, 50M, 50C, so that the respective toner images are overlapped on the conveyance belt 7. On the other hand, in case of the monochrome printing, the toner image is formed only by the process unit 50K and is transferred to the surface of the conveyance belt 7.

In the printing unit 10, the sheets placed in the sheet feeding tray 91 are picked up one at a time, which is then conveyed to the conveyance path 11. In the printing unit 10, the toner image transferred to the surface of the conveyance belt 7 is transferred to the sheet by the secondary transfer device 55. Thereafter, in the printing unit 10, the sheet having the toner image transferred thereto is conveyed to the fixing device 8, in which the toner image is then heat-fixed to the sheet. The fixed sheet is discharged to the sheet discharge tray 92.

Also, in each of the process units 50K, 50Y, 50M, 50C, after the transfer by the transfer device 5, the remnant toner, which remains on the surface of the photosensitive member 1 without being transferred, is scraped from the surface of the photosensitive member 1 by the cleaning blade 6. A part of the toner scraped from the surface of the photosensitive member 1 by the cleaning blade 6 stays at a contact part of the cleaning blade 6 and the photosensitive member 1, and the other toner is collected to a waste toner box (not shown). An amount of the toner staying at the contact part of the cleaning blade 6 and the photosensitive member 1 is reduced over time because it is collected to the waste toner box or escapes from the cleaning blade 6.

Figure 2:
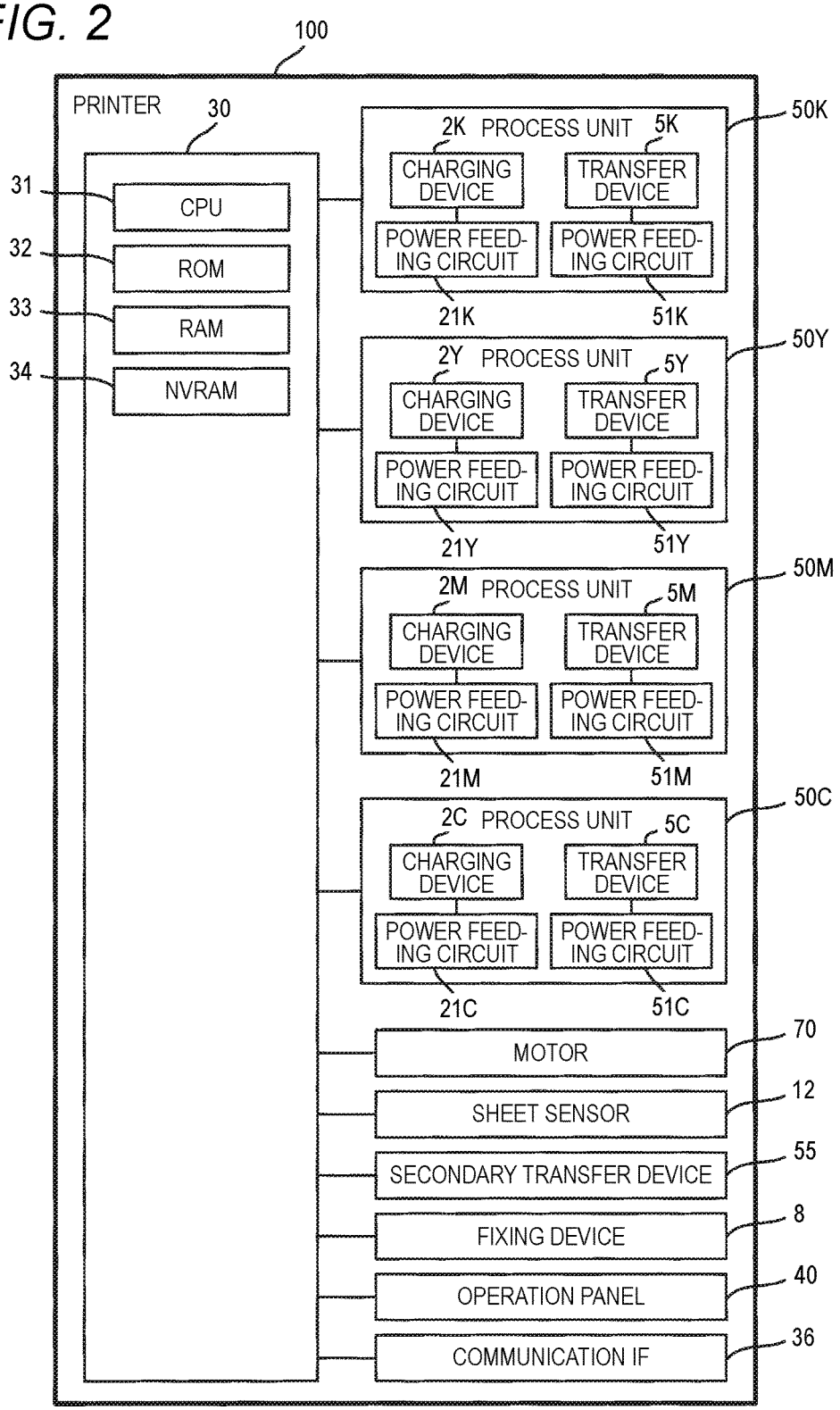
FIG. 2 is a block diagram depicting an electrical configuration of the printer according to the illustrative embodiment.

Subsequently, an electrical configuration of the printer 100 is described. As shown in FIG. 2, the printer 100 has a controller 30 having a CPU 31, a ROM 32, a RAM 33 and an NVRAM (Non Volatile RAM) 34. The controller 30 is electrically connected to the process units 50K, 50Y, 50M, 50C, a motor 70 becoming a driving source of the various rollers, the sheet sensor 12, the secondary transfer device 55, the fixing device 8, an operation panel 40, and a communication interface (communication IF) 36. The controller 30 may be a part of an ASIC or include the ASIC. Incidentally, the controller 30 of FIG. 2 is a collective name of the hardware that is to be used for control of the printer 100 such as the CPU 31, and does not indicate only the single hardware actually provided for the printer 100.

In the ROM 32, a variety of control programs for controlling the printer 100, an image processing program, a variety of settings and initial values, and the like are stored. The RAM 33 is used as a work area from which the various control programs are to be read out or as a storage area for temporarily storing image data that is to be transmitted via a variety of interfaces. The NVRAM 34 is a non-volatile storage unit and is used as a storage area for storing the various settings, the image data and the like.

The CPU 31 is configured to execute calculations for implementing a variety of functions of the printer 100 such as an image forming function, and plays a key role in the control. The CPU 31 is configured to store a processing result in the RAM 33 or the NVRAM 34 and to control the respective constitutional elements of the printer 100, in accordance with the control programs read out from the ROM 32. The CPU 31 is an example of the control device. Incidentally, the controller 30 may also be an example of the control device.

The motor 70 is a driving source of the rotary members that are to be used for image formation and sheet conveyance, such as the conveyance belt 7, the feeder roller 71 and the like. The fixing device 8, and the photosensitive member 1, the developing roller 411 and the transfer device 5 in each of the process unit 50K, 50Y, 50M, 50C are also rotated by the motor 70.

The communication IF 36 is the hardware enabling the wired or wireless communication with an external apparatus. The printer 100 is configured to receive a print job that is to be transmitted from the external apparatus, through the communication IF 36.

The operation panel 40 is the hardware enabling a display of a message and a variety of settings and an input of the various information from a user, and is provided on an external packaging of the printer 100. The operation panel 40 includes a touch panel having a display function and an input function, and a button group having a variety of input units such as a ten key, an arrow key, an OK button, a cancel button and the like.

Also, the printer 100 has an individual power feeding circuit configured to control power feeding from a power supply for each of the constitutional elements. In FIG. 2, a power feeding circuit 21K configured to control power feeding to the charging device 2K of the process unit 50K, a power feeding circuit 51K configured to control power feeding to the transfer device 5K of the process unit 50K, a power feeding circuit 21Y configured to control power feeding to the charging device 2Y of the process unit 50Y, a power feeding circuit 51Y configured to control power feeding to the transfer device 5Y of the process unit 50Y, a power feeding circuit 21M configured to control power feeding to the charging device 2M of the process unit 50M, a power feeding circuit 51M configured to control power feeding to the transfer device 5M of the process unit 50M, a power feeding circuit 21C configured to control power feeding to the charging device 2C of the process unit 50C and a power feeding circuit 51C configured to control power feeding to the transfer device 5C of the process unit 50C are shown. In addition, a power feeding circuit for the developing device 4 and a power feeding circuit for the exposure device 53 may be provided for each of the process units 50K, 50Y, 50M, 50C.

Subsequently, a reverse transfer operation of supplying the black (K) toner from the process unit 50K to the process units 50Y, 50M, 50C except for the process unit 50K in the printer 100 is described with reference to FIG. 3. In FIG. 3, the elements, which are not necessary for descriptions, of the respective process units 50K, 50Y, 50M, 50C are not shown. The printer 100 is configured to perform the reverse transfer operation in a non-sheet image formation in which an image to be printed on the sheet is not formed. The non-sheet image formation corresponds to a time period after a print job is completed, and a sheet interval during the print job, for example. The process unit 50K is an example of the first image forming unit, and the process units 50Y, 50M, 50C except for the process unit 50K are examples of the second image forming unit.

Figures 4, 5:
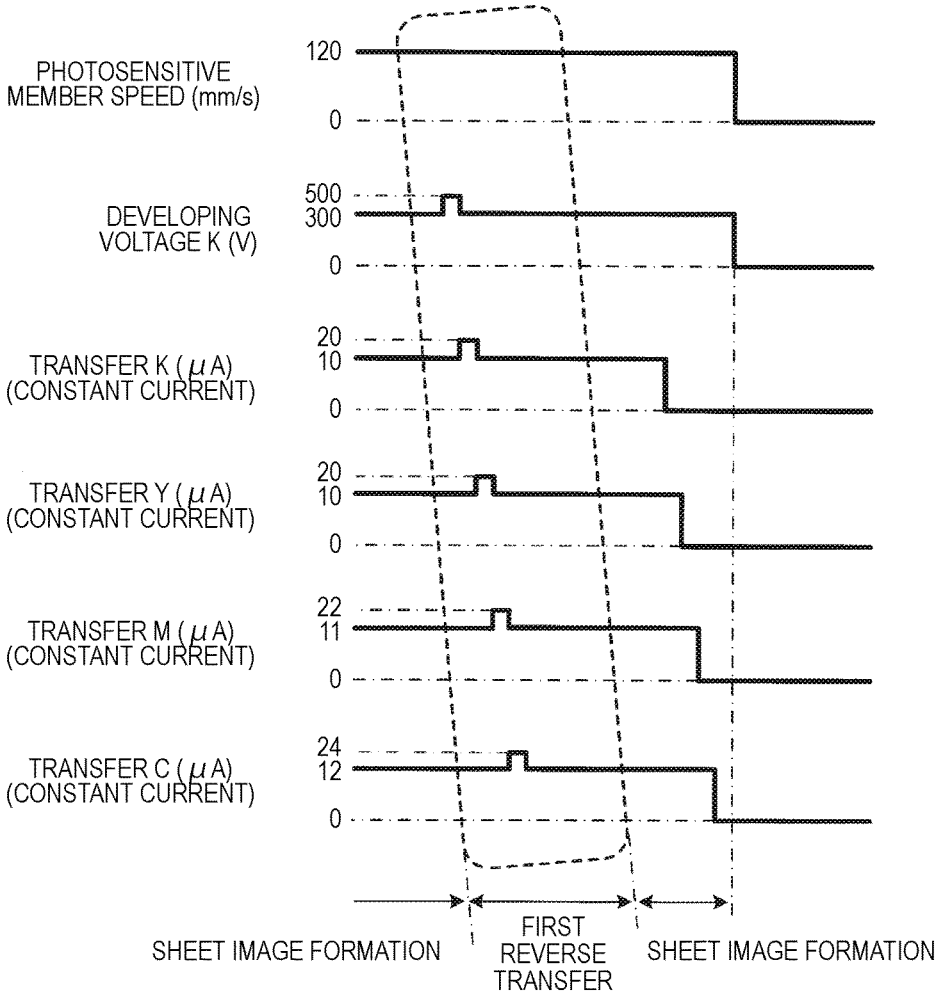
FIG. 4 depicts a list of controls of each device during a first reverse transfer operation.
FIG. 5 is a timing chart depicting outputs of each device during the first reverse transfer operation.

Incidentally, the printer 100 can perform five operations as the reverse transfer operation. In the below, the first to fifth reverse transfer operations are sequentially described. FIG. 4 depicts a list of controls of each device during the first reverse transfer operation. FIG. 5 depicts outputs of each device in time series during the first reverse transfer operation. The operations in the dotted-line range of FIG. 5 correspond to the first reverse transfer operation. The printer 100 executes the first reverse transfer operation at a sheet interval during the continuous monochrome printing.

Figure 3A:
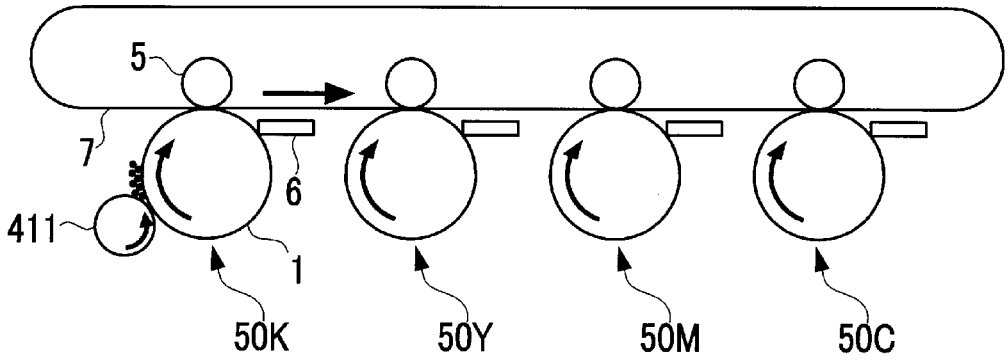
FIGS. 3A to 3C depict an outline of a reverse transfer operation of the printer according to the illustrative embodiment.

The printer 100 first enables the process unit 50K to form a pattern image, as the first reverse transfer operation (FIG. 3A). As the pattern image, a solid image is exemplified of which a length in a longitudinal direction becoming a rotating direction of the photosensitive member 1 is 1 to 10 mm and a width in a lateral direction perpendicular to the longitudinal direction is a maximum width of an image formation area of the photosensitive member 1.

In the formation process of the pattern image of the first reverse transfer operation, as shown in FIGS. 4 and 5, a rotating speed of the developing roller 411 and a rotating speed of the photosensitive member 1 are set to be the same as those in the sheet image formation in which an image to be printed on the sheet is formed, and an absolute value of the developing voltage, which is to be applied to the developing roller 411 at a moment of developing the pattern image, is set to be greater than an absolute value of the developing voltage in the sheet image formation. The absolute value of the developing voltage is increased, so that a toner amount per unit area, which is to be supplied onto the photosensitive member 1 when developing the pattern image, is increased. This formation process of the pattern image is an example of the developing adjustment processing and the formation processing. The CPU 31 may be configured to perform the formation process of the pattern image. For example, the CPU 31 may be configured to form the pattern image on the photosensitive member 1 of the process unit 50K, when the image to be printed on the sheet is not formed, by applying the developing voltage to the developing roller 411 of the process unit 50K.

Figure 3B:
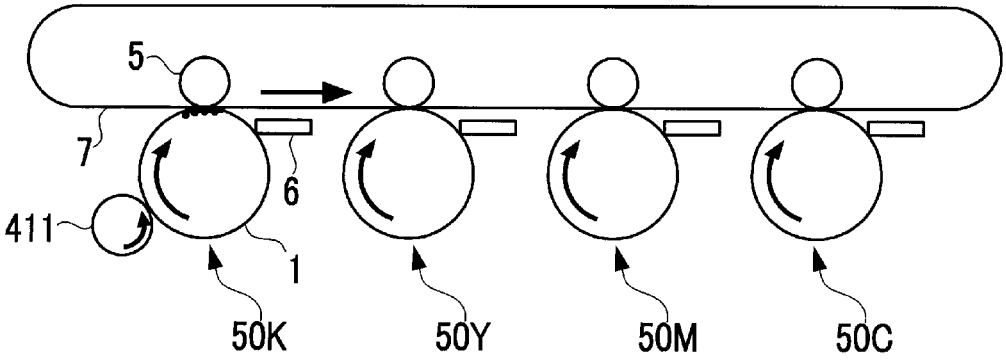

Thereafter, the printer 100 transfers the pattern image formed on the photosensitive member 1 of the process unit 50K onto the conveyance belt 7 by the transfer device 5 (FIG. 3B). In the transfer process of the pattern image of the first reverse transfer operation, as shown in FIGS. 4 and 5, a transfer current that is to be applied to the transfer device 5 of the process unit 50K is made to be greater than a transfer current to be applied thereto in the sheet image formation, during a time period for which the pattern image passes a position facing the transfer device 5 of the process unit 50K, in conformity to the conveyance of the pattern image on the photosensitive member 1. For the transfer device 5, a constant current control is performed by the set transfer current. The transfer current is increased, so that a charge amount of the toner to be transferred becomes greater than a charge amount of the toner to be transferred in the sheet image formation. Also, the transfer current is increased, so that a transfer voltage is also increased. This transfer process of the pattern image is an example of the transfer adjustment processing and the first transfer processing. The CPU 31 may be configured to perform the transfer process of the pattern image. For example, the CPU 31 may be configured to transfer the pattern image formed on the photosensitive member 1 of the process unit 50K onto the conveyance belt 7 by using the transfer device 5 of the process unit 50K. Further, in the transferring of the pattern image onto the conveyance belt 7, the CPU 31 may be configured to apply the transfer voltage or transfer current to the transfer device 5 of the process unit 50K, an absolute value of the transfer voltage or transfer current applied to the transfer device 5 of the process unit 50K in the transferring of the pattern image onto the conveyance belt 7 being greater than an absolute value of the transfer voltage or transfer current applied to the transfer device of the process unit 50K when the image to be printed on the sheet is formed.

Figure 3C:
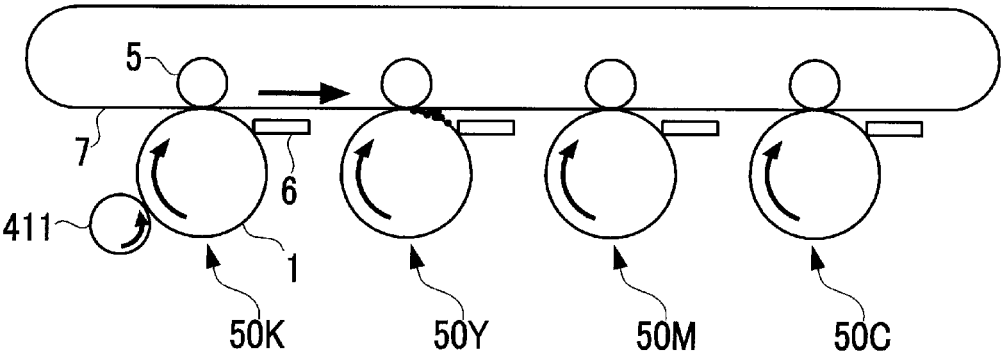

Thereafter, the printer 100 conveys the pattern image transferred onto the conveyance belt 7 to the process unit 50Y, and reversely transfers the pattern image onto the photosensitive member 1 by the transfer device 5 of the process unit 50Y (FIG. 3C). This reverse transfer process of the pattern image is an example of the second transfer processing. Also in the reverse transfer process of the pattern image, as shown in FIGS. 4 and 5, the transfer current having the same polarity as that in the sheet image formation is applied in conformity to the conveyance of the pattern image on the conveyance belt 7. Also, during a time period for which the pattern image passes a position facing the transfer device 5 of the process unit 50Y, the transfer current to be applied to the transfer device 5 of the process unit 50Y is set to be greater than the transfer current to be applied thereto in the sheet image formation. The transfer current is increased, so that the charge amount of the toner on the conveyance belt 7 is more increased than the charge amount of the toner to be transferred in the sheet image formation.

Incidentally, a constant voltage control, rather than the constant current control, may be performed for the transfer device 5. In this case, during the reverse transfer operation, a transfer voltage having the same polarity as that in the sheet image formation and an absolute value greater than that in the sheet image formation is preferably applied to the transfer device 5 of each of the process units 50K, 50Y. The CPU 31 may be configured to perform the reverse transfer process of the pattern image. For example, the CPU 31 may be configured to apply the transfer voltage or transfer current, which has the same polarity as that applied to the transfer device 5 of the process unit 50Y, 50M, 50C when the image to be printed on the sheet is formed, to the transfer device 5 of the process unit 50Y, 50M, 50C when the pattern image to be conveyed by the conveyance belt 7 passes the transfer device 5 of the process unit 50Y, 50M, 50C.

During the first reverse transfer operation, the absolute value of the developing voltage is increased to increase the supply amount of the toner per unit area, thereby increasing a thickness of a toner layer to be transferred to the conveyance belt 7. The thickness of the toner layer increases, so that an electrostatic capacity of the toner layer reduces and the charge amount of the toner increases. As a result, a potential difference between a side (referred to as a surface) of the toner layer transferred to the conveyance belt 7, which faces the photosensitive member 1, and a surface (referred to as a backside) of the toner layer contacting the conveyance belt 7 increases. Also, during the first reverse transfer operation, the transfer current is increased to further increase the charge amount of the toner and to further increase the potential difference in the toner layer. By this configuration, when the potential difference in the toner layer exceeds a threshold at which a discharging is generated, a discharging is generated between the surface and the backside of the toner layer, so that some toner of the toner layer is oppositely charged due to the discharging. Thereby, the oppositely charged toner is transferred to the surface of the photosensitive member 1.

The black (K) toner transferred to the photosensitive member 1 of the process unit 50Y by the reverse transfer is conveyed by the rotation of the photosensitive member 1 of the process unit 50Y, and is scraped from the surface of the photosensitive member 1 by the cleaning blade 6 of the process unit 50Y. Thereby, the toner is supplied to the contact part of the cleaning blade 6 and the photosensitive member 1 of the process unit 50Y, so that the friction occurring between the cleaning blade 6 and the photosensitive member 1 of the process unit 50Y is reduced and a sound and a turn-up caused due to the cleaning blade 6 of the process unit 50Y is suppressed.

Thereafter, the printer 100 conveys the pattern image left on the conveyance belt 7 to the process unit 50M, and transfers some toner onto the photosensitive member 1 by the transfer device 5 of the process unit 50M, like the process unit 50Y. Further, the printer 100 conveys the pattern image left on the conveyance belt 7 to the process unit 50C, and transfers some toner onto the photosensitive member 1 by the transfer device 5 of the process unit 50C, like the process units 50Y, 50M. In this way, the same reverse transfer operation as the process unit 50Y is performed for the process units 50M, 50C positioned downstream of the process unit 50Y, too, so that the black (K) toner is transferred to each photosensitive member 1 of the process units 50M, 50C. As a result, the sound and the turn-up caused due to each cleaning blade 6 of the process units 50M, 50C is suppressed.

Incidentally, during the first reverse transfer operation, the absolute value of the developing voltage and the transfer current of each process unit are set to be greater than those in the sheet image formation, thereby increasing the charge amount of the toner. However, only the absolute value of the developing voltage may be set to be greater than that in the sheet image formation, and the transfer current may be set to be the same as that in the sheet image formation. Also, it is not necessary to increase the transfer current in all the process units, and the transfer current may be set to be the same as that in the sheet image formation in some of the process units. However, when the transfer current is set to be greater than that in the sheet image formation, the discharging is more likely to be generated in the toner layer, so that the amount of the toner to be transferred to the photosensitive member 1 is increased. For this reason, it is preferably to make the transfer current greater than that in the sheet image formation in the transfer devices 5 of all the process units 50K, 50Y, 50M, 50C. Also, the absolute value of the developing voltage that is to be applied to the developing roller 411 may be kept to be high not only at the moment of developing the pattern image but also until the first reverse transfer operation is over.

Figures 6, 7:
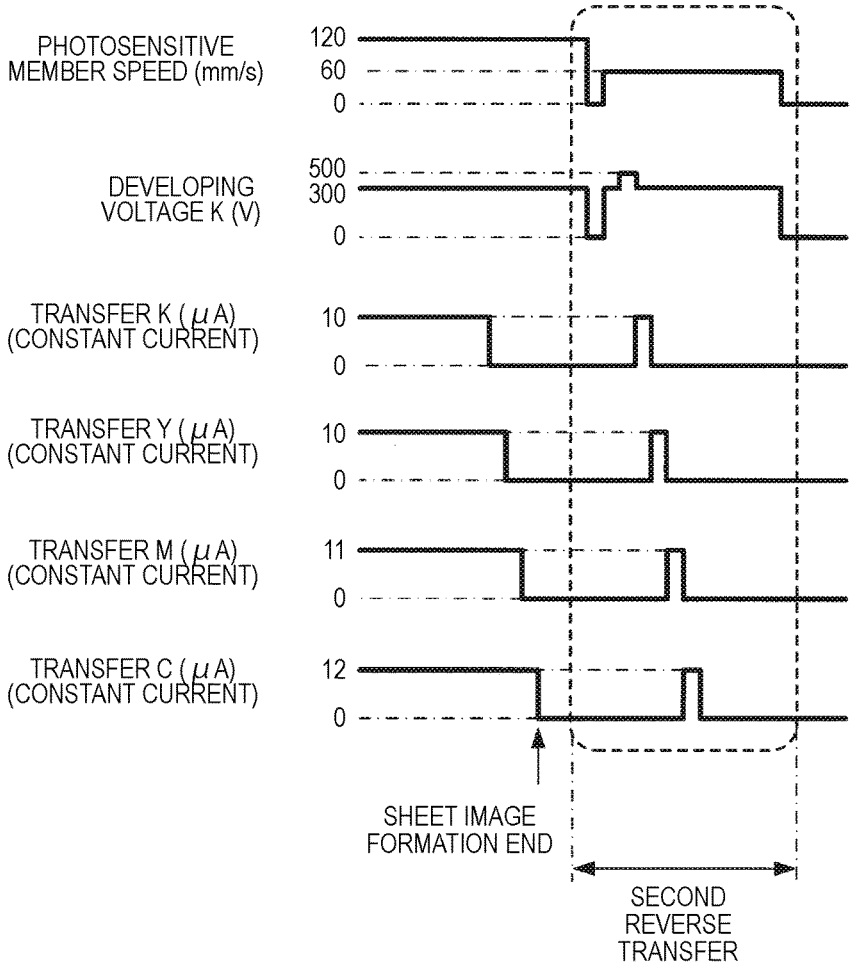
FIG. 6 depicts a list of controls of each device during a second reverse transfer operation.
FIG. 7 is a timing chart depicting outputs of each device during the second reverse transfer operation.

Subsequently, the second reverse transfer operation is described with reference to FIGS. 6 and 7. FIG. 6 depicts a list of controls of each device during the second reverse transfer operation. FIG. 7 depicts outputs of each device in time series during the second reverse transfer operation. The operations in the dotted-line range of FIG. 7 correspond to the second reverse transfer operation. The printer 100 executes the second reverse transfer operation when a next print job is not received after the print job is completed. The second reverse transfer operation is different from the first reverse transfer operation, in that the rotating speed of the photosensitive member 1 and the rotating speed of the conveyance belt 7 are decreased, the transfer current is not changed and the execution thereof is made after the print job is completed. Also, during the second reverse transfer operation, before the pattern image is formed, the applying of the driving force from the motor to the photosensitive member 1 and the applying of the developing voltage of the developing roller 411 are stopped. During the stops, each developing roller 411 of the process units 50Y, 50M, 50C is moved to the non-operating position.

The printer 100 first enables the process unit 50K to form the pattern image, as the second reverse transfer operation. In the formation process of the pattern image of the second reverse transfer operation, as shown in FIGS. 6 and 7, the rotating speed of the photosensitive member 1 is reduced to a half of the rotating speed in the sheet image formation without changing the rotating speed of the developing roller 411, so that the rotating speed of the photosensitive member 1 becomes slower than the rotating speed of the developing roller 411. A peripheral speed ratio, which is a ratio of the rotating speed of the photosensitive member 1 and the rotating speed of the developing roller 411, is made to be double as great as that in the sheet image formation. The rotating speed of the photosensitive member 1 is made to be less than that in the sheet image formation, so that the toner amount per unit area to be supplied to the photosensitive member 1 at the moment of developing the pattern image is increased. Incidentally, since the peripheral speed of the photosensitive member 1 and the speed of the conveyance belt 7 correspond to each other, the reduction in the rotating speed of the photosensitive member 1 is equivalent to the reduction in the toner conveying speed of the conveyance belt 7. Also, like the first reverse transfer operation, the printer 100 makes the developing voltage, which is to be applied to the developing roller 411 in the developing of the pattern image, higher than that in the sheet image formation. Thereby, the toner amount per unit area to be supplied to the photosensitive member 1 in the developing of the pattern image is also increased. The formation process of the pattern image is an example of the speed adjustment processing and the formation processing.

Then, the printer 100 transfers the pattern image formed on the photosensitive member 1 of the process unit 50K to the conveyance belt 7 by the transfer device 5 of the process unit 50K. In the transfer process of the pattern image of the second reverse transfer operation, as shown in FIGS. 6 and 7, the transfer current is set to be the same as that in the sheet image formation, unlike the first reverse transfer operation. However, during the second reverse transfer operation, the conveying speed of the conveyance belt 7 is also decreased by half in association with the speed reduction of the photosensitive member 1. For this reason, the time necessary for the transfer is doubled, as compared to that in the sheet image formation, and the charge amount of the pattern image is also increased, as compared to that in the sheet image formation.

Thereafter, the printer 100 conveys the pattern image transferred onto the conveyance belt 7 to the process unit 50Y, and reversely transfers the pattern image onto the photosensitive member 1 by the transfer device 5 of the process unit 50Y. Also in the reverse transfer process of the pattern image, as shown in FIGS. 6 and 7, the transfer current is set to be the same as that in the sheet image formation, but the conveying speed of the conveyance belt 7 is decreased by half, as compared to that in the sheet image formation, so that the charge amount of the toner on the conveyance belt 7 is increased, as compared to the charge amount of the toner that is to be transferred in the sheet image formation.

During the second reverse transfer operation, like the first reverse transfer operation, the developing voltage is increased to thicken the toner layer, thereby increasing the potential difference between the surface and the backside of the toner layer. Further, during the second reverse transfer operation, the rotating speed of the photosensitive member 1 and the conveying speed of the conveyance belt 7 are reduced, i.e., a ratio of the rotating speed of the developing roller 411 to the conveying speed of the conveyance belt 7 is increased without changing the rotating speed of the developing roller 411, so that the toner layer is further thickened and the charge amount of the toner is further increased. For this reason, the discharging is generated between the surface and the backside of the toner layer, so that some toner of the toner layer is oppositely charged. Thereby, the oppositely charged toner is transferred to the surface of the photosensitive member 1 of the process unit 50Y.

The reversely transferred black (K) toner is conveyed by the photosensitive member 1 of the process unit 50Y and is scraped from the surface of the photosensitive member 1 by the cleaning blade 6 of the process unit 50Y, like the first reverse transfer operation. Thereby, the toner is supplied to the contact part of the cleaning blade 6 and the photosensitive member 1 of the process unit 50Y, so that the sound and the turn-up caused due to the cleaning blade 6 of the process unit 50Y are suppressed. The black (K) toner is reversely transferred to the process units 50M, 50C, too, and the sound and the turn-up caused due to each cleaning blade 6 of the process units 50M, 50C are suppressed.

Incidentally, during the second reverse transfer operation, the transfer current is set to be the same as that in the sheet image formation. However, the transfer current may also be set to be greater than that in the sheet image formation, thereby further increasing the charge amount of the toner. The charge amount of the toner is increased, so that the discharging is more likely to be generated in the toner layer. Also in this case, it is not necessary to increase the transfer current in all the process units, and the transfer current may be set to be the same as that in the sheet image formation in some of the process units.

Also, during the second reverse transfer operation, the speeds of the photosensitive member 1 and the conveyance belt 7 are reduced to increase the ratio of the rotating speed of the developing roller 411 to the conveying speed of the conveyance belt 7, thereby increasing the toner amount per unit area. However, the developing roller 411 may be accelerated without changing the speeds of the photosensitive member 1 and the conveyance belt 7. Also in this case, the ratio of the rotating speed of the developing roller 411 to the conveying speed of the conveyance belt 7 is increased, so that the toner amount per unit area increases. However, when the speeds of the photosensitive member 1 and the conveyance belt 7 are reduced, the toner and the respective constitutional elements of the process unit 50K are less damaged than the configuration where the developing roller 411 is accelerated.

Figures 8, 9:
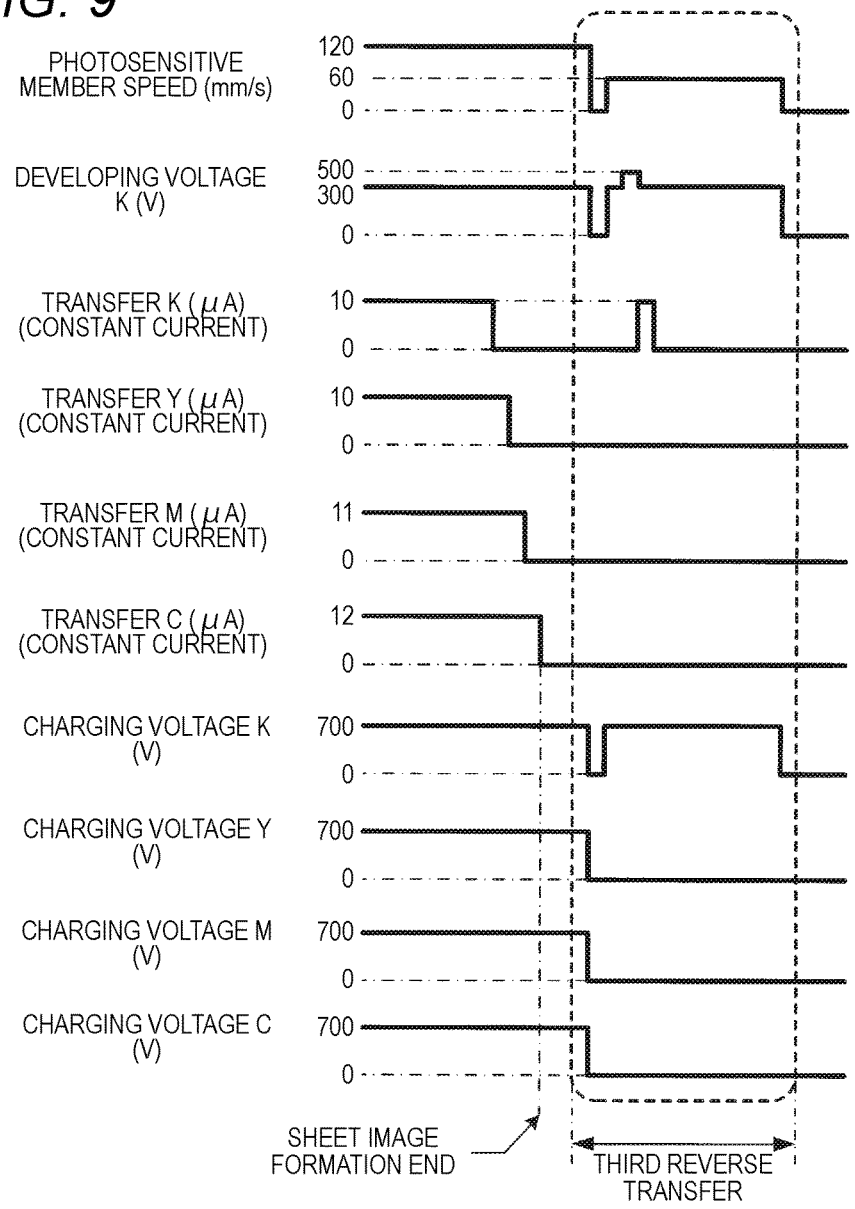
FIG. 8 depicts a list of controls of each device during a third reverse transfer operation.
FIG. 9 is a timing chart depicting outputs of each device during the third reverse transfer operation.

Subsequently, the third reverse transfer operation is described with reference to FIGS. 8 and 9. FIG. 8 depicts a list of controls of each device during the third reverse transfer operation. FIG. 9 depicts outputs of each device in time series during the third reverse transfer operation. The operations in the dotted-line range of FIG. 9 correspond to the third reverse transfer operation. Like the second reverse transfer operation, the printer 100 executes the third reverse transfer operation when a next print job is not received after the print job is completed. The third reverse transfer operation is different from the second reverse transfer operation, in that the transfer current and the charging voltage are not applied in the process units 50Y, 50M, 50C to which the black (K) toner is to be reversely transferred.

The printer 100 first enables the process unit 50K to form the pattern image, as the third reverse transfer operation. In the formation process of the pattern image of the third reverse transfer operation, as shown in FIGS. 8 and 9, like the second reverse transfer operation, the rotating speed of the photosensitive member 1 is reduced to a half of the rotating speed in the sheet image formation without changing the rotating speed of the developing roller 411, so that the rotating speed of the photosensitive member 1 becomes slower than the rotating speed of the developing roller 411. Also, like the first reverse transfer operation and the second reverse transfer operation, the printer 100 makes the developing voltage, which is to be applied to the developing roller 411 in the developing of the pattern image, higher than that in the sheet image formation. Thereby, the toner amount per unit area to be supplied to the photosensitive member 1 in the developing of the pattern image is increased. Incidentally, the charging voltage of the process unit 50K is the same as that in the sheet image formation.

Then, the printer 100 transfers the pattern image formed on the photosensitive member 1 of the process unit 50K to the conveyance belt 7 by the transfer device 5. During the third reverse transfer operation, the conveying speed of the conveyance belt 7 is also decreased in association with the reduction in the rotating speed of the photosensitive member 1, like the second reverse transfer operation. For this reason, the time necessary for the transfer is doubled, as compared to that in the sheet image formation, and the charge amount of the pattern image is also increased, as compared to that in the sheet image formation. Incidentally, the transfer current of the process unit 50K is the same as that in the sheet image formation.

Thereafter, the printer 100 conveys the pattern image transferred onto the conveyance belt 7 to the process unit 50Y, and reversely transfers the pattern image onto the photosensitive member 1 by the transfer device 5 of the process unit 50Y. In the reverse transfer process of the pattern image of the third reverse transfer operation, as shown in FIGS. 8 and 9, the transfer current is not applied to the transfer device 5 of the process unit 50Y at least for a time period for which the pattern image passes the transfer device 5 of the process unit 50Y. Also, the charging voltage of the charging device 2 of the process unit 50Y is not applied.

During the third reverse transfer operation, the rotating speed of the photosensitive member 1 and the conveying speed of the conveyance belt 7 are decreased by half by the process unit 50K, so that the pattern image having the thick toner layer is transferred onto the conveyance belt 7 and the charge amount of the toner is further increased in the transferring of the pattern image. Thereby, the potential difference between the surface and the backside of the toner layer on the conveyance belt 7 is increased. That is, the surface potential of the toner layer is high. When the toner layer is conveyed to the process unit 50Y to which the transfer current is not being applied and is contacted to the photosensitive member 1 that the charging voltage is not being applied thereto and is thus at a weakly charged state, since the surface potential of the toner layer is higher than the surface potential of the photosensitive member 1, some toner of the toner layer is closely attracted to the photosensitive member 1 of the process unit 50Y. Thereby, the black (K) toner is transferred to the surface of the photosensitive member 1 of the process unit 50Y.

The transferred black (K) toner is conveyed by the photosensitive member 1 of the process unit 50Y and is scraped from the surface of the photosensitive member 1 by the cleaning blade 6 of the process unit 50Y, like the first reverse transfer operation and the second reverse transfer operation. Thereby, the toner is supplied to the contact part of the cleaning blade 6 and the photosensitive member 1 of the process unit 50Y, so that the sound and the turn-up caused due to the cleaning blade 6 of the process unit 50Y are suppressed. The black (K) toner is transferred from the toner layer of the pattern image to the photosensitive member 1 in each of the process unit 50M, 50C, too, so that the sound and the turn-up caused due to each cleaning blade 6 of the process units 50M, 50C are suppressed.

Incidentally, during the third reverse transfer operation, in the pattern image formation, the developing voltage is increased and the speed of the photosensitive member 1 is reduced. However, the developing voltage may be increased or the speed of the photosensitive member 1 may be reduced. However, the surface potential of the toner layer can be further increased when the developing voltage is increased and the speed of the photosensitive member 1 is reduced. For this reason, it is preferably to increase the developing voltage and to reduce the speed of the photosensitive member 1. Also, during the third reverse transfer operation, the transfer current of the process unit 50K is set to be the same as that in the sheet image formation. However, like the first reverse transfer operation, the transfer current of the process unit 50K in the pattern image formation may be set to be greater than that in the sheet image formation, thereby increasing the charge amount of the toner. Also, during the third reverse transfer operation, the transfer currents of the process units 50Y, 50M, 50C are set to be zero (0). However, the transfer currents of the process units 50Y, 50M, 50C may be set to transfer currents greater than zero (0) and less than that in the sheet image formation. When the third reverse transfer operation is performed under the constant voltage control, the absolute value of the transfer voltage is preferably set to be smaller than that in the sheet image formation.

Further, during the third reverse transfer operation, the charging voltages of the process units 50Y, 50M, 50C are set to zero (0), so that the weakly charged state weaker than the charged state in the sheet image formation is made. However, in each process unit, the charging voltage may be applied and at least an area overlapping with the pattern image may be exposed so that the weakly charged state is made.

Figure 11:
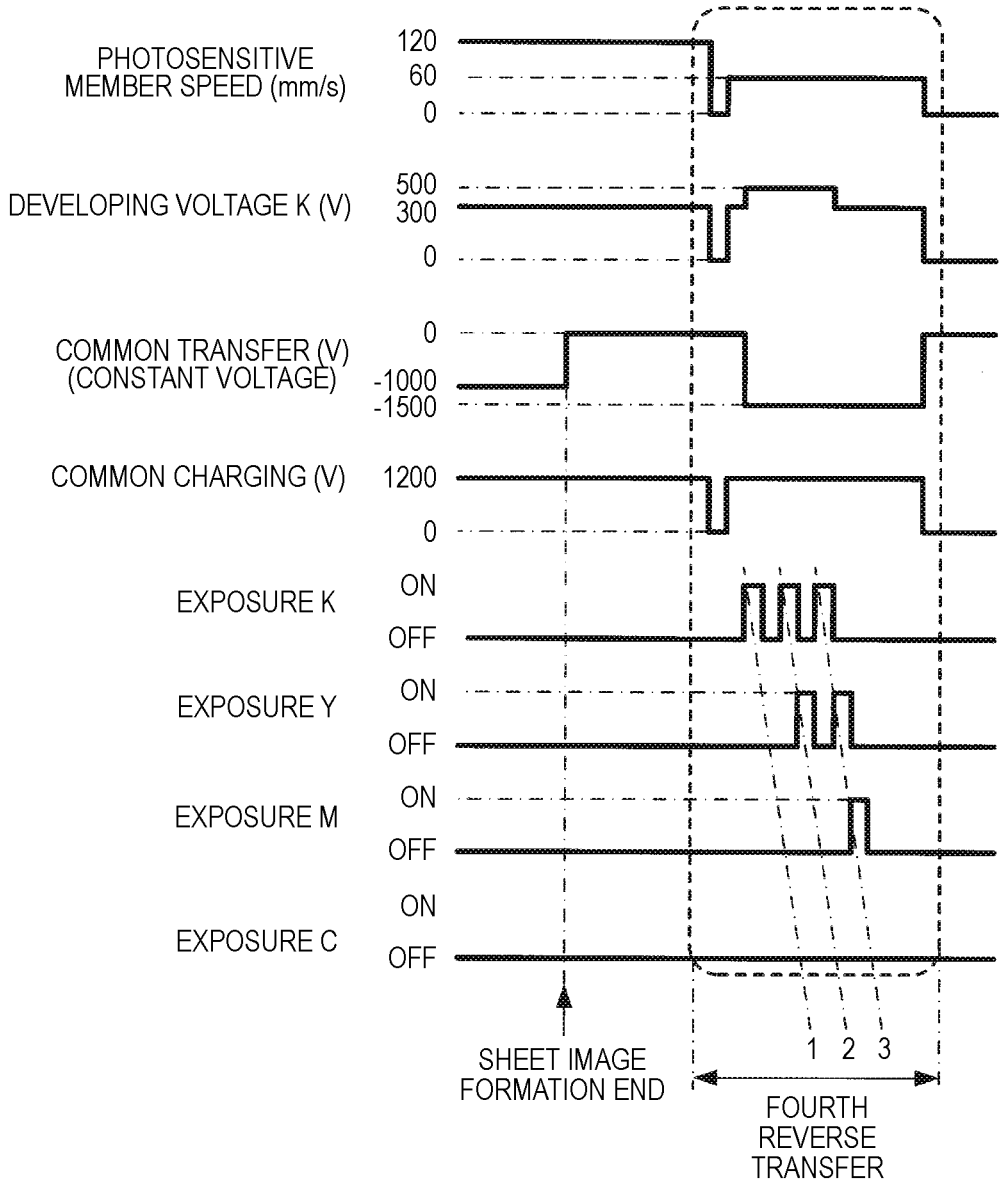
FIG. 11 is a timing chart depicting outputs of each device during the fourth reverse transfer operation.

Subsequently, the fourth reverse transfer operation is described with reference to FIGS. 10 and 11. FIG. 10 depicts a list of controls of each device during the fourth reverse transfer operation. FIG. 11 depicts outputs of each device in time series during the fourth reverse transfer operation. The operations in the dotted-line range of FIG. 11 correspond to the fourth reverse transfer operation. The printer 100 executes the fourth reverse transfer operation when a next print job is not received after the print job is completed, like the second reverse transfer operation and the third reverse transfer operation. The fourth reverse transfer operation is different from the second reverse transfer operation, in that the exposure is controlled for each of the process units 50K, 50Y, 50M, 50C.

Specifically, during the fourth reverse transfer operation, the pattern images having the same size are formed three times by the process unit 50K. In each of the process units 50Y, 50M, 50C, the exposure processing for parts corresponding to the respective pattern images is different. In the below, the three pattern images are referred to as a first pattern image, a second pattern image, and a third pattern image from an upstream side with respect to the conveying direction of the toner image to be transferred to the sheet. In FIG. 10, the control of each device during the reverse transfer operation for the first pattern image is referred to as 'fourth reverse transfer operation 1', the control of each device during the reverse transfer operation for the second pattern image is referred to as 'fourth reverse transfer operation 2', and the control of each device during the reverse transfer operation for the third pattern image is referred to as 'fourth reverse transfer operation 3'.

Figure 12:
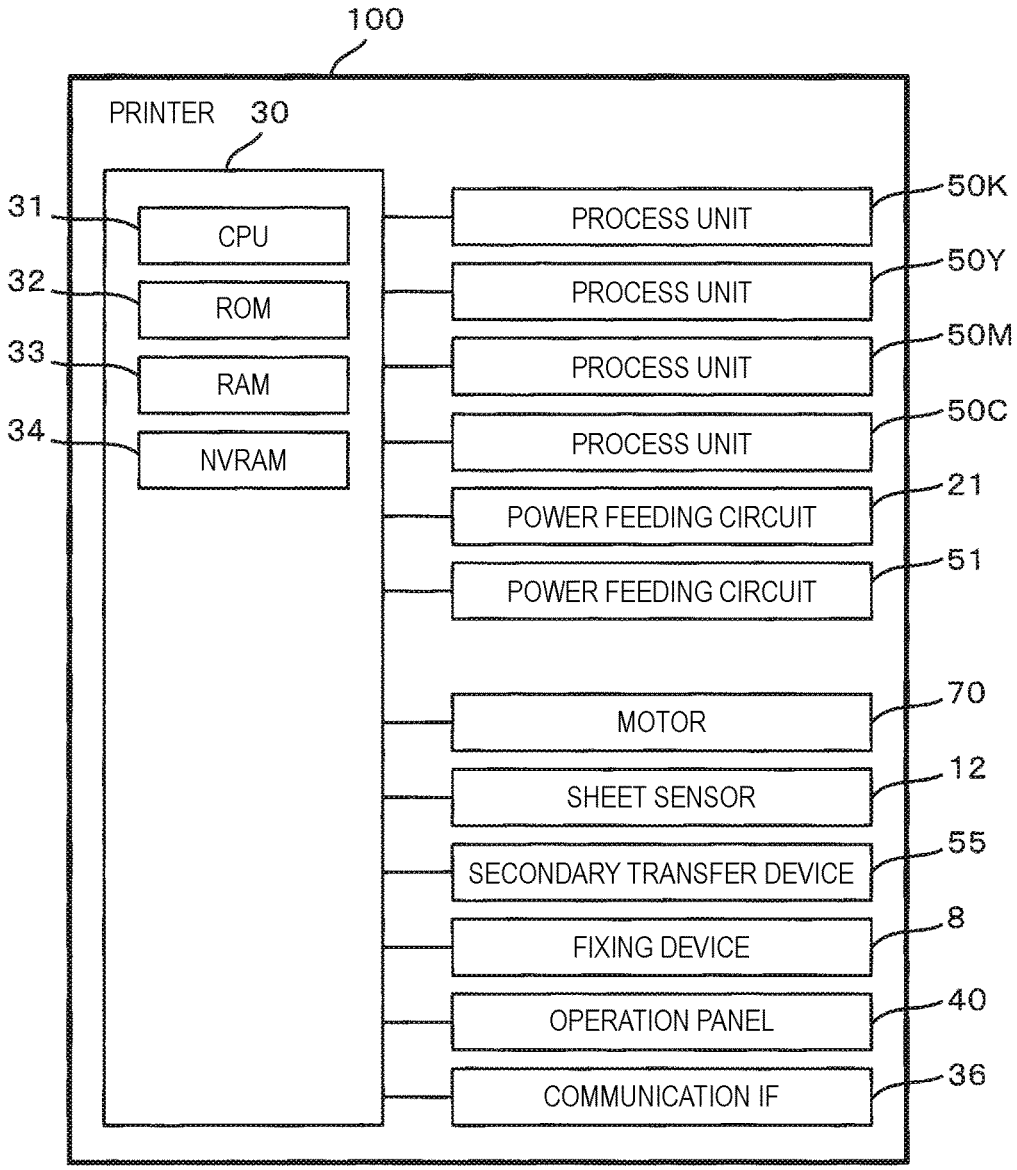
FIG. 12 is a block diagram depicting an electrical configuration of the printer relating to the fourth reverse transfer operation.

Also, during the fourth reverse transfer operation, the transfer operation and the charging operation are commonly performed in the respective process units 50K, 50Y, 50M, 50C. Thereby, it is not necessary to provide the printer 100 with the power feeding circuit for the transfer device 5 and the power feeding circuit for the charging device 2 in each of the process units 50K, 50Y, 50M, 50C, and as shown in FIG. 12, a power feeding circuit 51 for the transfer device 5 and a power feeding circuit 21 for the charging device 2, which are common to the process unit 50K, 50Y, 50M, 50C, are provided.

The printer 100 first enables the process unit 50K to sequentially form the respective pattern images, as the fourth reverse transfer operation. In the formation process of the pattern images of the fourth reverse transfer operation, like the second reverse transfer operation, the rotating speed of the photosensitive member 1 is reduced to a half of the rotating speed in the sheet image formation, so that the rotating speed of the photosensitive member 1 becomes slower than the rotating speed of the developing roller 411. Also, like the first reverse transfer operation and the second reverse transfer operation, the printer 100 makes the developing voltage, which is to be applied to the developing roller 411 in the developing of each pattern image, higher than that in the sheet image formation. Thereby, the toner amount per unit area to be supplied onto the photosensitive member 1 in the developing of each pattern image is increased.

Then, the printer 100 conveys the respective pattern images transferred onto the conveyance belt 7 to the process unit 50Y, and proceeds to the reverse transfer process. In the reverse transfer process of the pattern images of the fourth reverse transfer operation, as shown in FIGS. 10 and 11, an area of the photosensitive member 1 of the process unit 50Y, which overlaps with the first pattern image, is not exposed (refer to 'fourth reverse transfer operation 1' in FIG. 10), and areas thereof overlapping with the second pattern image and the third pattern image are exposed (refer to 'fourth reverse transfer operation 2' and 'fourth reverse transfer operation 3' in FIG. 10). The exposure process of the process unit 50Y is an example of the partial exposure processing.

Specifically, a time period after the exposure for the first pattern image is performed on the photosensitive member 1 of the process unit 50K until a tip of the first pattern image reaches the transfer position of the process unit 50K is defined as time T1, and the time T1 is set to be common to all of the process unit 50Y, the process unit 50M and the process unit 50C. A time period after the tip of the first pattern image reaches the transfer position of the process unit 50K until the tip of the first pattern image reaches the transfer position of the process unit 50Y is defined as time T2, and a time period until the first pattern image passes the transfer position of the process unit SOY from the tip to a rear end thereof is defined as time T3.

At this time, after the exposure for the second pattern image is performed on the photosensitive member 1 of the process unit 50K, the exposure is performed on the photosensitive member 1 of the process unit 50Y after the time T2 and then the exposure is over after the time T3. Thereby, the tip of the second pattern image and a tip of the exposed part of the photosensitive member 1 of the process unit 50Y are matched at the transfer position of the process unit 50Y. Also, the rear end of the second pattern image and a rear end of the exposed part of the photosensitive member 1 of the process unit 50Y are matched at the transfer position of the process unit 50Y. Then, the same processing as the second pattern image is performed for the third pattern image. That is, it is possible to perform the exposure at the areas overlapping with the second pattern image and the third pattern image without performing the exposure at the area overlapping with the first pattern image.

Since the charging control is performed by the common power feeding circuit 21, the printer 100 continues to apply the charging voltage to the charging devices 2 of the respective process units 50K, 50Y, 50M, 50C from at least a timing at which the first pattern image is formed by the process unit 50K until the third pattern image passes the transfer position of the process unit 50C. Also, since the transfer control is performed by the common power feeding circuit 51, the printer 100 continues to apply the transfer voltage to the transfer devices 5 of the respective process units 50K, 50Y, 50M, 50C from at least a timing at which the first pattern image is transferred by the process unit 50K until the third pattern image passes the transfer position of the process unit 50C.

During the fourth reverse transfer operation, the toner oppositely charged by the discharging is closely attracted and reversely transferred to the high potential photosensitive member 1 in the area in which the exposure is not performed, like the second reverse transfer operation. On the other hand, in the area in which the exposure is performed, the surface potential of the photosensitive member 1 is low, so that it is difficult for the toner oppositely charged by the discharging to be closely attracted to the photosensitive member 1.

That is, since the exposure is not performed for the first pattern image in the process unit 50Y, much toner is reversely transferred. For this reason, the toner is supplied to the contact part of the cleaning blade 6 and the photosensitive member 1 of the process unit 50Y, so that the sound and the turn-up caused due to the cleaning blade 6 of the process unit 50Y are suppressed. On the other hand, since the exposure is performed for the second pattern image and the third pattern image, much toner remains on the conveyance belt 7. At this state, the toner is conveyed to the process unit 50M positioned downstream of the process unit 50Y.

Then, the printer 100 does not perform the exposure in the areas of the photosensitive member 1 of the process unit 50M, which overlap with the first pattern image and the second pattern image (refer to 'fourth reverse transfer operation 1' and 'fourth reverse transfer operation 2' in FIG. 10), and performs the exposure in the area overlapping with the third pattern image (refer to 'fourth reverse transfer operation 3' in FIG. 10).

Since the exposure is not performed for the first pattern image and the second pattern image in the process unit 50M, much toner is reversely transferred. Particularly, since the toner of the second pattern image has been little transferred to the photosensitive member 1 of the process unit 50Y, much toner is reversely transferred. That is, much toner is reversely transferred to even the process unit 50M positioned downstream of the process unit 50Y. Incidentally, since the exposure is performed for the third pattern image, much toner remains on the conveyance belt 7. At this state, the toner is conveyed to the process unit 50C positioned downstream of the process unit 50M.

Then, the printer 100 does not perform the exposure for all the pattern images in the process unit 50C (refer to ' fourth reverse transfer operation 1', 'fourth reverse transfer operation 2' and 'fourth reverse transfer operation 3' in FIG. 10). Since the exposure is not performed for the respective pattern images in the process unit 50C, much toner is reversely transferred. Particularly, since the toner of the third pattern image has been little transferred to the photosensitive member 1 of the process unit 50Y and photosensitive member 1 of the process unit 50M, much toner is reversely transferred. That is, much toner is reversely transferred to the most downstream process unit 50C, too.

During the fourth reverse transfer operation, the toner oppositely charged by the discharging is transferred to the surfaces of the photosensitive members 1 of the process units except for the process unit 50K by the same mechanism as the second reverse transfer operation. Further, in the upstream-side process unit of the process units except for the process unit 50K, the part corresponding to a part of the pattern images that are formed during the fourth reverse transfer operation is exposed, so that it is possible to secure the amount of the toner that is to be supplied to the downstream-side process unit, without performing the individual transfer control or charging control.

Incidentally, during the fourth reverse transfer operation, the exposure is not performed for the first pattern image, for which the exposure was not performed by the upstream-side process unit 50Y, i.e., the pattern image already used for the reverse transfer of the toner, in addition to the second pattern image of the photosensitive member 1 of the process unit 50M, for example. However, the exposure may be performed for the first pattern image. However, since the toner, which can be reversely transferred, remains not a little on even the pattern image, which has been already used for the reverse transfer of the toner, the corresponding pattern image is preferably used for the reverse transfer in the downstream-side process unit, too.

Figure 14:
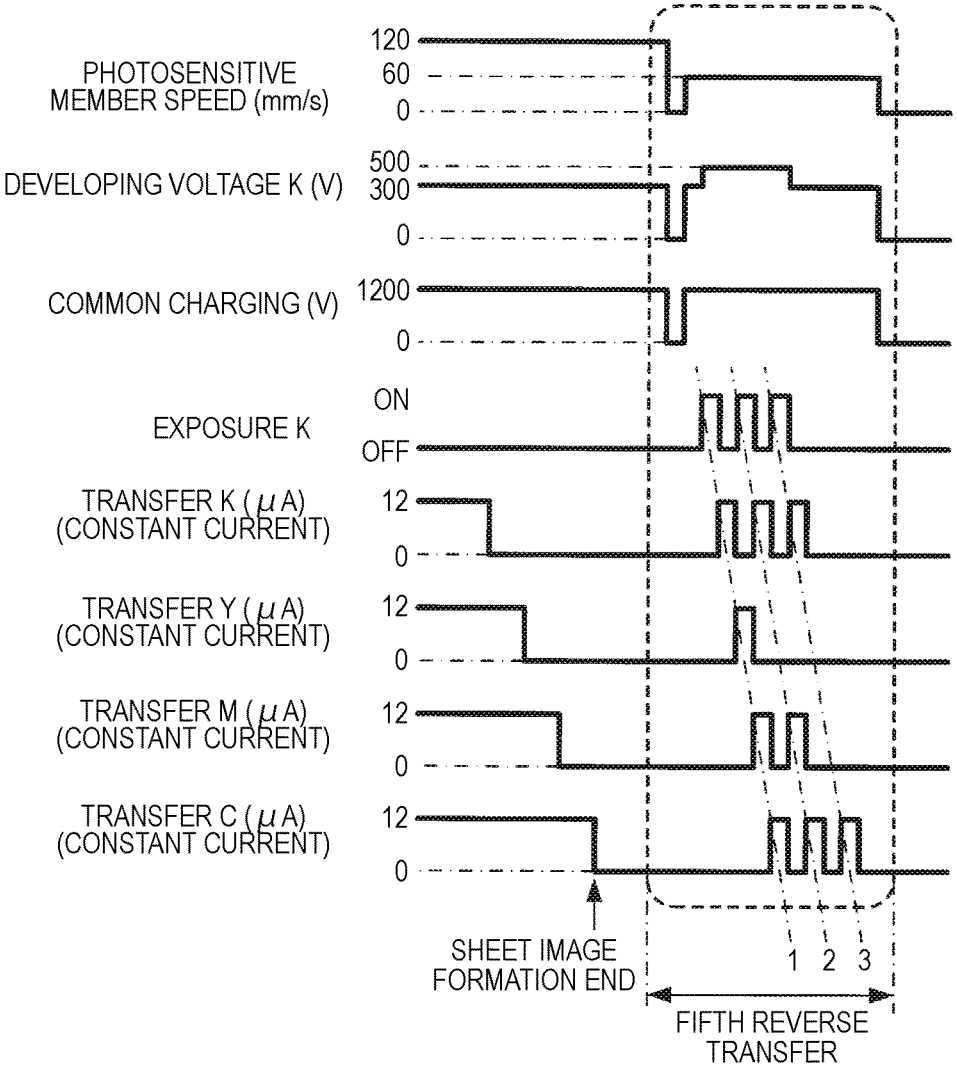
FIG. 14 is a timing chart depicting outputs of each device during the fifth reverse transfer operation.

Subsequently, the fifth reverse transfer operation is described with reference to FIGS. 13 and 14. FIG. 13 depicts a list of controls of each device during the fifth reverse transfer operation. FIG. 14 depicts outputs of each device in time series during the fifth reverse transfer operation. The operations in the dotted-line range of FIG. 14 correspond to the fourth reverse transfer operation. The printer 100 executes the fifth reverse transfer operation when a next print job is not received after the print job is completed, like the fourth reverse transfer operation. The fifth reverse transfer operation is an application example of the fourth reverse transfer operation and is different from the fourth reverse transfer operation, in that the transfer current is controlled for each of the process units 50Y, 50M, 50C.

Specifically, during the fifth reverse transfer operation, the three pattern images of the first pattern image, the second pattern image and the third pattern image are also formed. In FIG. 13, the control of each device during the reverse transfer operation for the first pattern image is referred to as 'fifth reverse transfer operation 1', the control of each device during the reverse transfer operation for the second pattern image is referred to as 'fifth reverse transfer operation 2', and the control of each device during the reverse transfer operation for the third pattern image is referred to as 'fifth reverse transfer operation 3'. As shown in FIG. 13, during the fifth reverse transfer operation, in each of the process units 50Y, 50M, 50C, the applying of the transfer current to the respective pattern images is different.

Figure 15:
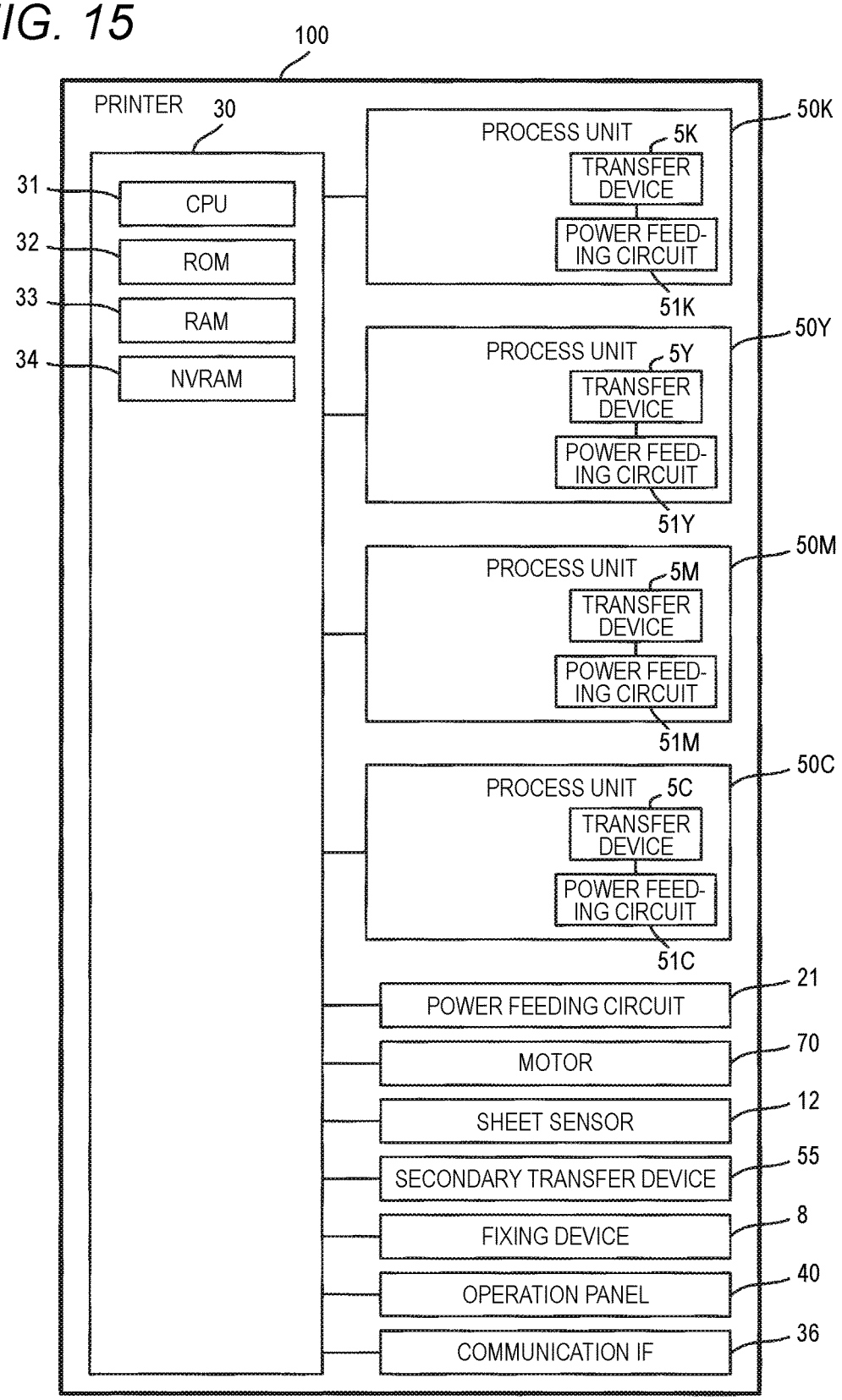
FIG. 15 is a block diagram depicting an electrical configuration of the printer relating to the fifth reverse transfer operation.

Also, during the fifth reverse transfer operation, the charging operation is commonly performed in each of the process units 50K, 50Y, 50M, 50C. For this reason, as shown in FIG. 15, the printer 100 is provided with the power feeding circuit 21 for the charging device 2, which is common to the process units 50K, 50Y, 50M, 50C. Incidentally, in order to individually control the transfer operation, the power feeding circuit for the transfer device 5 is respectively provided for the process units 50K, 50Y, 50M, 50C.

The printer 100 first enables the process unit 50K to sequentially form the respective pattern images, as the fifth reverse transfer operation, like the fourth reverse transfer operation. Then, the printer 100 conveys the respective pattern images transferred onto the conveyance belt 7 to the process unit 50Y, and proceeds to the reverse transfer process. In the reverse transfer process of the pattern images of the fifth reverse transfer operation, as shown in FIGS. 13 and 14, the transfer current having the same polarity as that in the sheet image formation is applied to the first pattern image (refer to 'fifth reverse transfer operation 1' in FIG. 13) and does not apply the transfer current to the second pattern image and the third pattern image (refer to 'fifth reverse transfer operation 2' and 'fifth reverse transfer operation 3' in FIG. 13) in the transfer device 5 of the process unit 50Y.

During the fifth reverse transfer operation, when the transfer current is applied, the discharging is likely to be generated between the surface and the backside of the toner layer, like the second reverse transfer operation, and the toner oppositely charged by the discharging is reversely transferred to the photosensitive member 1. On the other hand, when the transfer current is not applied, the charge amount of the toner does not increase and the discharging is difficult to be generated. For this reason, the toner is difficult to be oppositely charged and to be thus closely attracted to the photosensitive member 1.

That is, in the process unit 50Y, since the transfer current is applied to the first pattern image, much toner is reversely transferred. For this reason, the toner is supplied to the contact part of the cleaning blade 6 and the photosensitive member 1 of the process unit 50Y, so that the sound and the turn-up caused due to the cleaning blade 6 of the process unit 50Y are suppressed. On the other hand, since the transfer current is not applied to the second pattern image and the third pattern image, much toner remains on the conveyance belt 7. At this state, the toner is conveyed to the process unit 50M positioned downstream of the process unit 50Y.

The printer 100 applies the transfer current to the first pattern image and the second pattern image on the photosensitive member 1 of the process unit 50M (refer to ' fifth reverse transfer operation 1' and 'fifth reverse transfer operation 2' in FIG. 13) and does not apply the transfer current to the third pattern image (refer to 'fifth reverse transfer operation 3' in FIG. 13).

In the process unit 50M, since the transfer current is applied to the first pattern image and the second pattern image, much toner is reversely transferred. Particularly, since the toner of the second pattern image has been little transferred to the photosensitive member 1 of the process unit 50Y, much toner is reversely transferred. That is, like the fourth reverse transfer operation, much toner is reversely transferred to even the process unit 50M positioned downstream of the process unit 50Y. On the other hand, since the transfer current is not applied to the third pattern image, much toner remains on the conveyance belt 7. At this state, the toner is conveyed to the process unit 50C positioned downstream of the process unit 50M.

Then, the printer 100 applies the transfer current to all the pattern images in the process unit 50C (refer to 'fifth reverse transfer operation 1', 'fifth reverse transfer operation 2' and 'fifth reverse transfer operation 3' in FIG. 13), so that much toner is reversely transferred. Particularly, since the toner of the third pattern image has been little transferred to the photosensitive member 1 of the process unit 50Y and the photosensitive member 1 of the process unit 50M, much toner is reversely transferred. That is, much toner is reversely transferred to even the most downstream-side process unit 50C.

During the fifth reverse transfer operation, the toner oppositely charged by the discharging is transferred to the surfaces of the photosensitive members 1 of the process units except for the process unit 50K by the same mechanism as the second reverse transfer operation. Further, in the upstream-side process unit of the process units except for the process unit 50K, the transfer current is not applied to the part corresponding to a part of the pattern images that are formed during the fifth reverse transfer operation, so that it is possible to secure the amount of the toner to be supplied to the downstream-side process unit without performing the individual charging control.

Subsequently, job execution processing is described as the control of the printer 100 for executing the reverse transfer operation. In the below, an operation that is to be executed when a monochrome printing mode is set in the printer 100 is referred to as a first aspect and an operation that is to be executed when a monochrome printing mode is not set in the printer 100 is referred to as a second aspect.

The printer 100 has a monochrome printing mode in which the printing is performed using only the process unit 50K. In the monochrome printing mode, only the process unit 50K is used. Therefore, even when an error such as toner deficiency occurs in the process units except for the process unit 50K, the printing can be executed inasmuch as an error does not occur in the process unit 50K.

Figure 16:
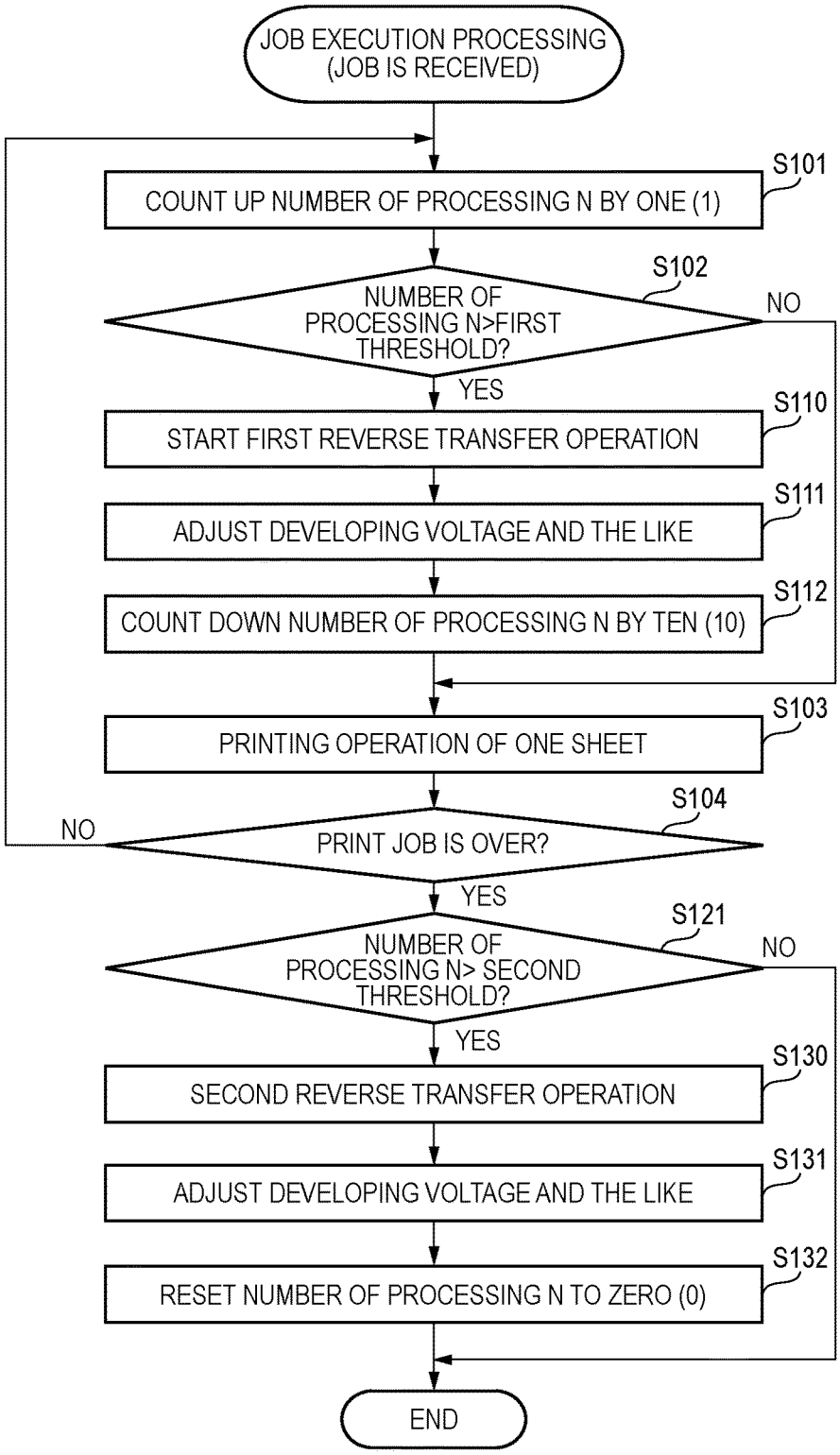
FIG. 16 is a flowchart depicting a sequence of job execution processing of a first aspect.

First, the job execution processing of the first aspect is described with reference to a flowchart of FIG. 16. The job execution processing is executed by the CPU 31 when the printer 100 receives a print job through the operation panel 40 or the communication IF 36.

In the job execution processing of the first aspect, the printer 100 first counts up the number of processing N by one (1) (S101). The number of processing N is a variable that is to be counted up by one (1) whenever one sheet is printed, and is stored in the RAM 33 or the NVRAM 34. The number of processing N is used to determine whether or not to execute the reverse transfer operation.

Then, the printer 100 determines whether the number of processing N is greater than a first threshold (S102). In the first aspect, the first threshold is set to 99. When the number of processing N is greater than the first threshold (S102: YES), there is a high possibility that the toner to be supplied to the respective blades 6 of the process units 50Y, 50M, 50C except for the process unit 50K will be depleted because the printing operation using only the black (K) toner has been continuously performed. Therefore, the printer 100 starts to execute the first reverse transfer operation that can be performed between the sheets (S110). As the first reverse transfer operation is started, the printer 100 adjusts the variety of voltages or currents so as to increase the developing voltage in the developing of the pattern image and to increase the transfer current in the transferring of the pattern image, as shown in FIGS. 4 and 5 (S111). Since the first reverse transfer operation is performed between the sheets without reducing the rotating speed of the photosensitive member 1 and the conveying speed of the conveyance belt 7, it little influences the productivity. After S111, the printer 100 counts down the number of processing N by ten (10) (S112).

After S112 or when the number of processing N is not greater than the first threshold (S102: NO), the printer 100 executes the printing operation of one sheet (S103). Then, the printer 100 determines whether the print job is completed (S104). When the print job is not completed (S104: NO), the printer 100 proceeds to S101 and performs the operation for printing a next page.

When the print job is completed (S104: YES), the printer 100 determines whether the number of processing N is greater than a second threshold (S121). The second threshold is a value smaller than the first threshold. In the first aspect, the second threshold is set to 50. When the number of processing N is greater than the second threshold (S121: YES), a possibility that the toner on the process units 50Y, 50M, 50C except for the process unit 50K will not be sufficient is low but a possibility that the toner will be deficient in the near future upon execution of the print job is high. Therefore, the printer 100 starts to execute the second reverse transfer operation so as to prevent the toner deficiency upon execution of a future print job (S130). As the second reverse transfer operation is started, the printer 100 increases the developing voltage in the pattern image formation and reduces the speeds of the photosensitive member 1 and the conveyance belt 7, as shown in FIGS. 6 and 7 (S131).

Incidentally, in S131, any one of the third reverse transfer operation, the fourth reverse transfer operation and the fifth reverse transfer operation may be performed instead of the second reverse transfer operation. After S131, the printer 100 resets the number of processing N to zero (0) (S132). After S132, or when the number of processing N is not greater than the second threshold (S121: NO), the printer 100 ends the job execution processing.

Figure 17:
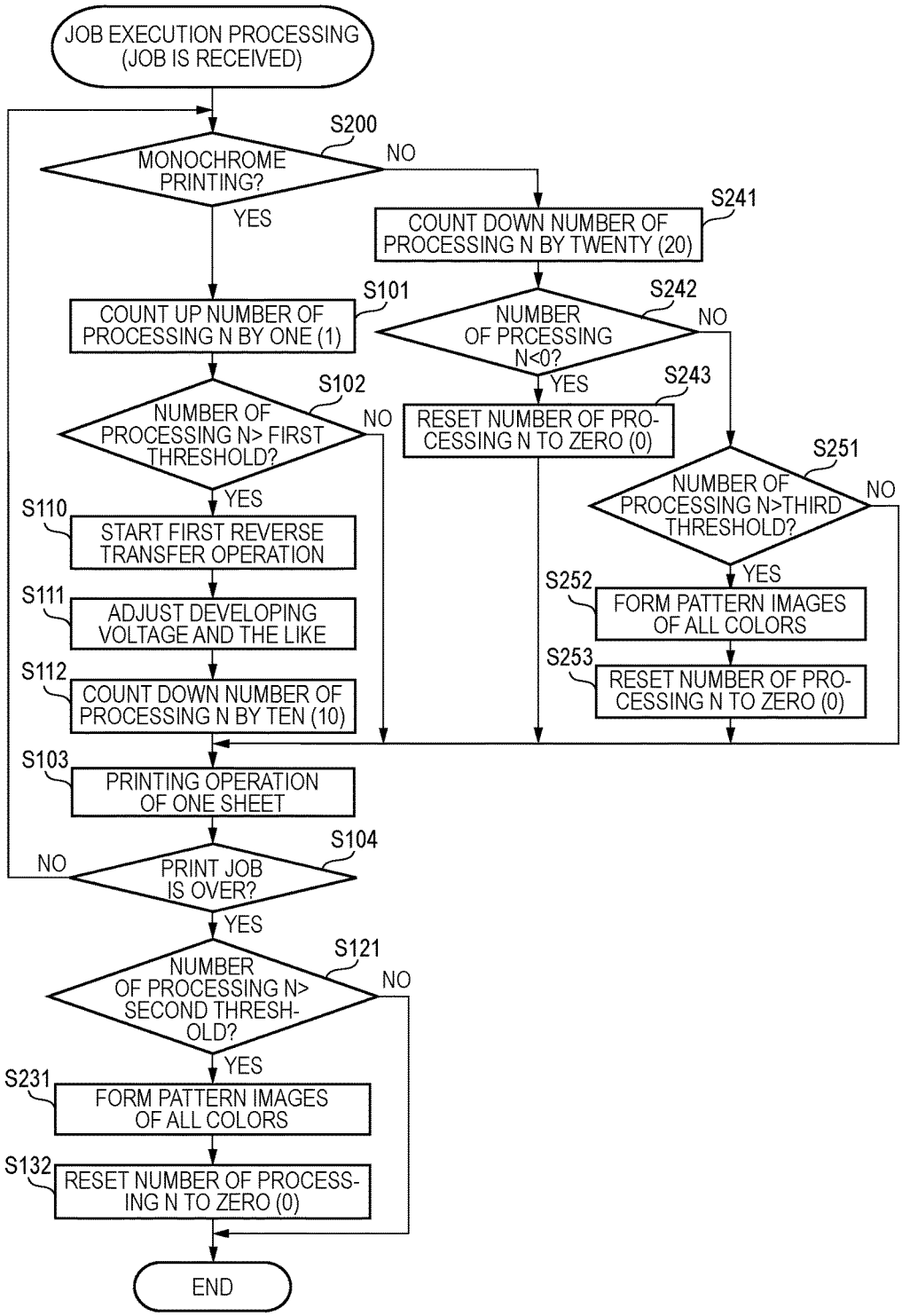
FIG. 17 is a flowchart depicting a sequence of job execution processing of a second aspect.

Subsequently, the job execution processing of the second aspect is described with reference to a flowchart of FIG. 17. In the job execution processing of the second aspect, the same processing as the first aspect is denoted by the same reference numerals and the descriptions thereof are omitted.

In the job execution processing of the second aspect, the printer 100 first determines whether a print job is a monochrome printing (S200). The determination as to whether a print job is a monochrome printing can be made by an instruction of a monochrome printing or a determination result of the number of colors of an image. When a print job is a monochrome printing (S200: YES), the printer 100 proceeds to S101 and performs the same printing operation as the first aspect.

On the other hand, when a print job is not a monochrome printing (S200: NO), since the toners are supplied from the respective process units 50K, 50Y, 50M, 50C by the color printing, the printer 100 counts downs the number of processing N by twenty (20) (S241).

After S241, the printer 100 determines whether the number of processing N is smaller than zero (0) (S242). When the number of processing N is smaller than zero (0) (S242: YES), a possibility that the toners on the process units 50Y, 50M, 50C except for the process unit 50K will be deficient is very low and the toners are supplemented onto the photosensitive members 1 by an additional color printing. Therefore, the printer 100 resets the number of processing N to zero (0) (S243). After S243, the printer 100 proceeds to S103 and executes the color printing operation of one sheet.

On the other hand, when the number of processing N is not smaller than zero (0) (S242: NO), the printer 100 determines whether the number of processing N is greater than a third threshold (S251). The third threshold is a value smaller than the first threshold, and is set to 50 in the second aspect. When the number of processing N is greater than the third threshold (S251: YES), a possibility that the toners on the process units 50Y, 50M, 50C except for the process unit 50K will not be sufficient is low but there is a possibility that a printing operation using only the black (K) toner will be thereafter continued. Therefore, the printer 100 forms the pattern images by the respective process units 50K, 50Y, 50M, 50C so as to prevent the toner deficiency during the print job (S252). Thereby, the toners are supplied onto the photosensitive members 1 of the process units 50K, 50Y, 50M, 50C.

After S252, the printer 100 resets the number of processing N to zero (0) (S253). After S253 or when the number of processing N is not greater than the third threshold (S251: NO), the printer 100 proceeds to S103 and executes the color printing operation of one sheet.

Also, after the print job is completed (S104: YES), when the number of processing N is greater than the second threshold (S121: YES), the printer 100 forms the pattern images by the respective process units 50K, 50Y, 50M, 50C so as to prevent the toner deficiency upon execution of a future print job (S231). After S231, the printer 100 resets the number of processing N to zero (0) (S132) and ends the job execution processing.

As specifically described above, according to the printer 100, the pattern image of which the amount of the toner per unit area is large is formed by the most upstream process unit 50K, and the discharging is generated in the toner layer. Some toner in the toner layer is oppositely charged by the discharging and is transferred to the photosensitive members 1 of the process units 50Y, 50M, 50C positioned downstream of the process unit 50K. That is, according to the printer 100, the toner of the process unit 50K is reversely transferred to the photosensitive members 1 of the process units 50Y, 50M, 50C by the transfer voltage or transfer current having the same polarity as that in the sheet image formation, so that the friction occurring between the cleaning blade 6 and the photosensitive member 1 can be reduced.

Also, during the first reverse transfer operation, it is not necessary to change the speed of the photosensitive member 1 and the like and the control is simpler than the second reverse transfer operation and the like, so that the first reverse transfer operation can be easily performed even during the execution of the print job. Incidentally, it is not possible to supply the toner equal to or more than the toner on the developing roller 411 just by increasing the developing voltage, like the first reverse transfer operation. However, during the second reverse transfer operation and the like, the rotating speed of the photosensitive member 1 is reduced to increase the amount of the toner that can be supplied from the developing roller 411, so that it is possible to more securely increase the toner amount per unit area.

Also, the printer 100 of the illustrative embodiment can supply the toner to the photosensitive members 1 of the process units 50Y, 50M, 50C even when the toners of the process units 50Y, 50M, 50C are deficient, as compared to the configuration where the toner is directly supplied from the process units 50Y, 50M, 50C except for the process unit 50K. Also, it is not necessary to perform the operation of enabling the process units 50Y, 50M, 50C to contact the developing rollers 411 to the photosensitive members 1 during the print job, so that it is possible to avoid the shock accompanied by the operation of the developing roller 411 even during the monochrome print job.

Incidentally, the above-described illustrative embodiment is just exemplary and is not construed to limit the disclosure. Therefore, the disclosure can be variously improved and modified without departing from the gist of the disclosure. For example, the disclosure is not limited to the printer and can be applied to any apparatus having a color printing function, such as a complex machine, a FAX apparatus and the like.

Also, in the above-described illustrative embodiment, the toner image formed by each of the process units 50K, 50Y, 50M, 50C is once transferred to the conveyance belt 7 and then the toner image on the conveyance belt 7 is transferred to the sheet by the secondary transfer device 55. However, the toner image formed by each of the process units 50K, 50Y, 50M, 50C may be directly transferred to the sheet. However, when executing the fourth reverse transfer operation, since the transfer voltage is continuously applied during the operation and the transfer voltage may be instable if the sheet is conveyed, the printer is preferably a secondary transfer type.

Also, in the above-described illustrative embodiment, the common exposure device is provided for the respective process units. However, each process unit may have the exposure device, individually. That is, the exposure device may be included in the process unit. Also, the charging polarity of the toner is not limited to the positive polarity and may be a negative polarity.

Also, the processing disclosed in the illustrative embodiment may be executed by the hardware such as a single CPU, a plurality of CPUs, an ASIC and the like or a combination thereof. Also, the processing disclosed in the illustrative embodiment can be implemented in a variety of aspects such as a recording medium having a program for executing the processing recorded therein, a method and the like.

What is claimed is:

1. An image forming apparatus comprising:

a belt;

a first process unit comprising:

a first photosensitive drum contacting the belt;

a first charger positioned to charge a surface of the first photosensitive drum;

a first developing device comprising a first developing roller positioned to supply toner to the surface of the first photosensitive drum; and a first transfer device contacting the belt, the first transfer device being positioned to face the first photosensitive drum with the belt being interposed therebetween;

a second process unit comprising:

a second photosensitive drum contacting the belt, the second photosensitive drum being different from the first photosensitive drum;

a second charger positioned to charge a surface of the second photosensitive drum;

a second developing device comprising a second developing roller positioned to supply toner to the surface of the second photosensitive drum;

a second transfer device contacting the belt, the second transfer device being positioned to face the second photosensitive drum with the belt being interposed therebetween; and a controller electrically connected to the first process unit and the second process unit, wherein, when an image to be printed on a sheet is not formed, the controller is configured to:

operate the first process unit to form a pattern image on the first photosensitive drum by applying a first developing voltage to the first developing roller, wherein an absolute value of the first developing voltage applied to the first developing device when the pattern image is formed on the first photosensitive drum is greater than an absolute value of a second developing voltage applied to the first developing roller when the image to be printed on a sheet is formed, and to transfer the pattern image formed on the first photosensitive drum onto the belt by using the first transfer device; and operate the second process unit to reversely transfer the pattern image conveyed by the belt onto the second photosensitive drum by applying a first transfer voltage or a first transfer current to the second transfer device, wherein an absolute value of the first transfer voltage or the first transfer current applied to the second transfer device when the pattern image is formed on the first photosensitive drum is smaller than an absolute value of a second transfer voltage or a second transfer current applied to the second transfer device when the image to be printed on a sheet is formed, and by controlling a surface potential of a transferring area of the second photosensitive drum to be lower than a surface potential of the pattern image on the belt, the transferring area overlapping with the pattern image conveyed by the belt.

2. The image forming apparatus according to claim 1, wherein the controller is configured to operate the second process unit not to apply a charging voltage of the second charger in the reversely transferring of the pattern image conveyed by the belt onto the second photosensitive drum.

3. The image forming apparatus according to claim 1, further comprising an exposure device positioned to expose a surface of the second photosensitive drum by emitting light, wherein, in the reversely transferring of the pattern image conveyed by the belt onto the second photosensitive drum, the controller is configured to operate the second process unit to apply a charging voltage of the second charger, and the exposure device is configured to expose the transferring area of the charged surface of the second photosensitive drum by emitting light.

4. The image forming apparatus according to claim 1, wherein the controller is configured to operate the first process unit to adjust a ratio of a rotating speed of the first developing roller to a toner conveying speed of the belt in the transferring of the pattern image onto the belt to be greater than the ratio of the rotating speed of the first developing roller to the toner conveying speed of the belt when an image to be printed on a sheet is formed.

5. The image forming apparatus according to claim 4, wherein the controller is configured to operate the first process unit to adjust the toner conveying speed of the belt in the transferring of the pattern image onto the belt to be slower than the toner conveying speed of the belt when an image to be printed on a sheet is formed.

6. The image forming apparatus according to claim 1, wherein the controller is configured to operate the first process unit to apply a transfer voltage or transfer current to a first transfer device in the transferring of the pattern image onto the belt, wherein an absolute value of the transfer voltage or transfer current applied to the first transfer device in the transferring of the pattern image onto the belt is greater than an absolute value of the transfer voltage or transfer current applied to the first transfer device when an image to be printed on a sheet is formed.

7. The image forming apparatus according to claim 1, wherein the first process unit further comprises a first power feeding circuit electrically connected to the first charger, and wherein the second process unit further comprises a second power feeding circuit which is different from the first power feeding circuit electrically connected to the second charger.

8. The image forming apparatus according to claim 1, wherein the first process unit further comprises a first power feeding circuit electrically connected to the first transfer device, and wherein the second process unit further comprises a second power feeding circuit which is different from the first power feeding circuit electrically connected to the second charger.

9. An image forming apparatus, comprising:

a belt;

a first process unit comprising:

a first photosensitive drum contacting the belt;

a first charger positioned to charge a surface of the first photosensitive drum;

a first developing device comprising a first developing roller and positioned to supply toner to the surface of the first photosensitive drum; and a first transfer device contacting the belt, the first transfer device being positioned to face the first photosensitive drum with the belt being interposed therebetween;

a second process unit comprising:

a second photosensitive drum contacting the belt, the second photosensitive drum being different from the first photosensitive drum;

a second charger positioned to charge a surface of the second photosensitive drum;

a second developing device comprising a second developing roller positioned to supply toner to the surface of the second photosensitive drum; and a second transfer device contacting the belt, the second transfer device being positioned to face the second photosensitive drum with the belt being interposed therebetween; and a controller electrically connected to the first process unit and the second process unit, wherein, when an image to be printed on a sheet is not formed, the controller is configured to:

operate the first process unit to form a pattern image on the first photosensitive drum by using the first developing device, wherein a ratio of a rotating speed of the first developing roller to a toner conveying speed of the belt in the forming of the pattern image onto the belt is greater than a ratio of the rotating speed of the first developing roller to the toner conveying speed of the belt when an image to be printed on a sheet is formed, and to transfer the pattern image formed on the first photosensitive drum onto the belt by using the first transfer device; and operate the second process unit to reversely transfer the pattern image conveyed by the belt onto the second photosensitive drum by applying a first transfer voltage or a first transfer current to the second transfer device, wherein an absolute value of the first transfer voltage or the first transfer current is smaller than an absolute value of a second transfer voltage or a second transfer current applied to the second transfer device when the image to be printed on a sheet is formed, and by controlling a surface potential of a transferring area of the second photosensitive drum to be lower than a surface potential of the pattern image on the belt, the transferring area overlapping with the pattern image conveyed by the belt.

10. The image forming apparatus according to claim 9, wherein the controller is configured to operate the second process unit not to apply a charging voltage of the second charger in the reversely transferring of the pattern image conveyed by the belt onto the second photosensitive drum.

11. The image forming apparatus according to claim 9, further comprising an exposure device positioned to expose a surface of the second photosensitive drum by emitting light, wherein, in the reversely transferring of the pattern image conveyed by the belt onto the second photosensitive drum, the controller is configured to operate the second process unit to apply a charging voltage of the second charger, and the exposure device is configured to expose the transferring area of the charged surface of the second photosensitive drum by emitting light.

12. The image forming apparatus according to claim 9, wherein the controller is configured to operate the first process unit to adjust the toner conveying speed of the belt in the transferring of the pattern image onto the belt to be slower than the toner conveying speed of the belt when an image to be printed on a sheet is formed.

13. The image forming apparatus according to claim 9, wherein the controller is configured to operate the first process unit to apply a transfer voltage or transfer current to a first transfer device in the transferring of the pattern image onto the belt, wherein an absolute value of the transfer voltage or transfer current applied to the first transfer device in the transferring of the pattern image onto the belt is greater than an absolute value of the transfer voltage or transfer current applied to the first transfer device when an image to be printed on a sheet is formed.

14. The image forming apparatus according to claim 9, wherein the first process unit further comprises a first power feeding circuit electrically connected to the first charger, and wherein the second process unit further comprises a second power feeding circuit which is different from the first power feeding circuit electrically connected to the second charger.

15. The image forming apparatus according to claim 9, wherein the first process unit further comprises a first power feeding circuit electrically connected to the first transfer device, and wherein the second process unit further comprises a second power feeding circuit which is different from the first power feeding circuit electrically connected to the second charger.

16. An image forming apparatus, comprising:

a belt;

a first process unit comprising:

a first photosensitive drum contacting the belt;

a first charger positioned to charge a surface of the first photosensitive drum;

a first developing device comprising a first developing roller positioned to supply toner to the surface of the first photosensitive drum; and a first transfer device contacting the belt, the first transfer device being positioned to face the first photosensitive drum with the belt being interposed therebetween;

a second process unit comprising:

a second photosensitive drum contacting the belt, the second photosensitive drum being different from the first photosensitive drum;

a second charger positioned to charge a surface of the second photosensitive drum;

a second developing device comprising a second developing roller positioned to supply toner to the surface of the second photosensitive drum; and a second transfer device contacting the belt, the second transfer device being positioned to face the second photosensitive drum with the belt being interposed therebetween; and a controller electrically connected to the first process unit and the second process unit, wherein, when an image to be printed on a sheet is not formed, the controller is configured to:

operate the first process unit to form a pattern image on the first photosensitive drum by using the first developing device and to transfer the pattern image formed on the first photosensitive drum onto the belt by applying a first transfer voltage or a first transfer current to the first transfer device, wherein an absolute value of the first transfer voltage or the first transfer current applied to the first transfer device in the transferring of the pattern image onto the belt is greater than an absolute value of a first developing voltage or a first developing current applied to the first developing device when the image to be printed on a sheet is formed; and operate the second process unit to reversely transfer the pattern image conveyed by the belt onto the second photosensitive drum by applying a second transfer voltage or a second transfer current to the second transfer device, wherein an absolute value of the second transfer voltage or the second transfer current is smaller than an absolute value of a third transfer voltage or a third transfer current applied to the second transfer device when the image to be printed on a sheet is formed, and by controlling a surface potential of a transferring area of the second photosensitive drum to be lower than a surface potential of the pattern image on the belt, the transferring area overlapping with the pattern image conveyed by the belt.

17. The image forming apparatus according to claim 16, wherein the controller is configured to operate the second process unit not to apply a charging voltage of the second charger in the reversely transferring of the pattern image conveyed by the belt onto the second photosensitive drum.

18. The image forming apparatus according to claim 16, further comprising an exposure device positioned to expose a surface of the second photosensitive drum by emitting light, wherein, in the reversely transferring of the pattern image conveyed by the belt onto the second photosensitive drum, the controller is configured to operate the second process unit to apply a charging voltage of the second charger, and the exposure device is configured to expose the transferring area of the charged surface of the second photosensitive drum by emitting light.

19. The image forming apparatus according to claim 16, wherein the first process unit further comprises a first power feeding circuit electrically connected to the first charger, and wherein the second process unit further comprises a second power feeding circuit which is different from the first power feeding circuit electrically connected to the second charger.

20. The image forming apparatus according to claim 16, wherein the first process unit further comprises a first power feeding circuit electrically connected to the first transfer device, and wherein the second process unit further comprises a second power feeding circuit which is different from the first power feeding circuit electrically connected to the second charger.

* * * * *